US006595265B2

(12) United States Patent
Kikuchi et al.

(10) Patent No.: US 6,595,265 B2
(45) Date of Patent: Jul. 22, 2003

(54) FAN, METHOD FOR PRODUCING THE FAN BY MOLDING MOLTEN METAL, AND DEVICE FOR PRODUCING THE FAN BY MOLDING MOLTEN METAL

(75) Inventors: Hitoshi Kikuchi, Tokyo (JP); Yoshimi Iwamura, Tokyo (JP); Yasuyoshi Makino, Tokyo (JP); Jiro Fukuyama, Tokyo (JP); Hideaki Miyagawa, Tokyo (JP); Akio Endo, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/984,151

(22) Filed: Oct. 29, 2001

(65) Prior Publication Data

US 2002/0023728 A1 Feb. 28, 2002

Related U.S. Application Data

(62) Division of application No. 09/517,428, filed on Mar. 2, 2000.

(30) Foreign Application Priority Data

| | | |
|---|---|---|
| Mar. 3, 1999 | (JP) | 11-055123 |
| Mar. 3, 1999 | (JP) | 11-055124 |
| Dec. 17, 1999 | (JP) | 11-358935 |
| Dec. 17, 1999 | (JP) | 11-358936 |

(51) Int. Cl.[7] ..... B22D 13/00
(52) U.S. Cl. ..... 164/113; 164/119; 164/312
(58) Field of Search ..... 164/113, 119, 164/120, 312; 416/178

(56) References Cited

U.S. PATENT DOCUMENTS

| | | | | |
|---|---|---|---|---|
| 4,671,739 A | * | 6/1987 | Read et al. | 416/134 R |
| 5,290,149 A | * | 3/1994 | Vieth | 416/188 |
| 5,328,332 A | * | 7/1994 | Chiang | 416/186 R |
| 5,655,875 A | * | 8/1997 | Sekine | 192/113.32 |
| 5,988,579 A | * | 11/1999 | Wang | 416/178 |
| 6,146,094 A | * | 11/2000 | Obana et al. | 415/200 |

FOREIGN PATENT DOCUMENTS

| | | |
|---|---|---|
| JP | 2-2000 | 1/1990 |
| JP | 7-23600 | 7/1990 |
| JP | 3-54337 | 11/1991 |
| JP | 2667748 | 11/1992 |
| JP | 5-45838 | 11/1993 |
| JP | 2566183 | 1/1994 |
| JP | 9-126189 | 5/1997 |
| JP | 9-228995 | 9/1997 |
| JP | 10-205493 | 8/1998 |

OTHER PUBLICATIONS

Nikkei Mechanical Dec. 9, 1996, vol. 495.
Nikkei Mechanical Mar. 1998, vol. 522.
Kogyo Zairyo May 1998, vol. 46, Bo. 5.
Kogyo Zairyo Oct. 1998, vol. 46, No. 10.
Magnesium Dokuhon (no date).

* cited by examiner

*Primary Examiner*—M. Alexandra Elve
*Assistant Examiner*—Len Tran
(74) *Attorney, Agent, or Firm*—Burns, Doane, Swecker & Mathis, LLP

(57) ABSTRACT

A fan according to the present invention can be monolithically molded out of a metal with a low energy in combination with a structure of a metal mold, in which gate arrangement and/or distribution of dimensions of vanes is devised in injecting a low melting-point metal such as magnesium, wherein not only production but also reproducing such as recycling are facilitated, and also a metalwave of the fan can be produced in consideration of the global atmosphere preservation.

7 Claims, 21 Drawing Sheets

CONVENTIONAL EXAMPLE
COPPER PLATE

EMBODIMENT OF THE INVENTION
MAGNESIUM ALLOY

A-A

A-A

B-B

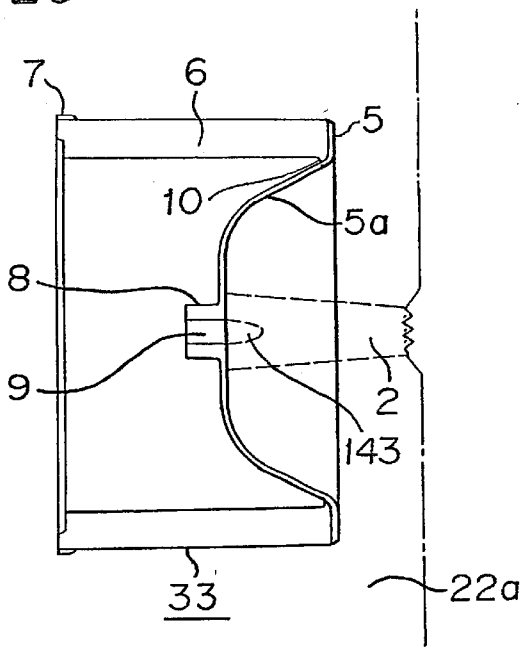
FIG. 23
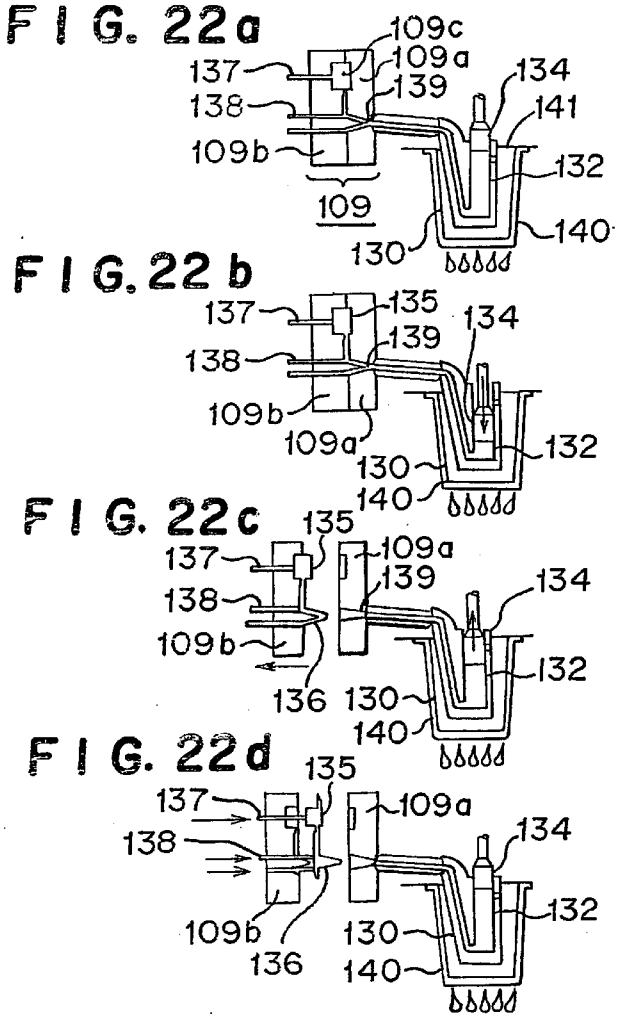
FIG. 22a
FIG. 22b
FIG. 22c
FIG. 22d

FAN, METHOD FOR PRODUCING THE FAN BY MOLDING MOLTEN METAL, AND DEVICE FOR PRODUCING THE FAN BY MOLDING MOLTEN METAL

This application is a divisional of application Ser. No. 09/517,428, filed on Mar. 2, 2000.

FIELD OF THE INVENTION

The present invention relates to a technology for producing a sirocco and a propeller fan by molding an alloy having a low fusion point, such as a magnesium alloy, in use of, for example, injection molding.

DISCUSSION OF BACKGROUND

A sirocco fan made of a metal is mainly used in cases that noncombustibility is required to avoid a fire in, for example, a kitchen and that an ambient temperature becomes high. Sirocco fans are ordinarily made from a thin steel plate or a thin aluminum plate, a main plate having a rotation shaft, a side plate on an air invent side, and a plurality of vanes. These components are fixed by, for example, a caulked joint. Therefore, in a structure using the thin steel plate, the weights of the components are increased, whereby balancing becomes important. Further, in case of using the thin aluminum plate, a material cost is expanded, and it becomes difficult to weld the caulked portion for reinforcement. In Japanese Utility Model No. 1792736, Japanese Unexamined Utility Model Publication JP-A-62-14199, Japanese Unexamined Patent Publication JP-A-8-42495 disclose that a joint of a caulked portion is reinforced by successively welding after caulking by coating, or by bonding, became the joint is weak.

In Japanese Unexamined Patent Publication JP-9-126189 and Japanese Patent No. 2667748, a technology that a sirocco fan is monolithically molded out of a plastic. In FIG. 39, a structure of a fan monolithically molded out of a plastic is shown. In FIG. 39, numerical reference 31 designates a centrifugal blower; numerical reference 33 designates an impeller, constructed by main vanes 40, auxiliary vanes 41, and a cone-like stiffening plate 37, which impeller is accommodated in a case 32 and a bottom surface 42; numerical reference 43 designates a shaft boss, directly connected to a motor 34, for rotating the impeller; numerical reference 39 designates a stiffening ring for holding the impeller so as to be shaped like a cylinder; and numerical reference 35 and 36 respectively designate an air outlet and an air inlet, which are provided in a case.

Such an impeller is monolithically molded as a final product such that a resin is injected from a resin injecting gate, located apart from the shaft boss, into a cavity of a separated molding die and applied with heat and a temperature. Thus, the main vanes and the auxiliary vanes, both of which are thin, and the stiffening ring are monolithically formed. However, because leaves (lvs) of a metal mold is large, and a molten metal is hard to flow in a method of producing such as an aluminum die-cast, it is difficult to construct thin vanes of 1 through 2 mm.

However, because it is difficult to reuse a material of a plastic, particularly of a strengthen special plastic, in which a glass fiber is mixed like a fan. Therefore, an admixture is changed to a metal in consideration of the global atmosphere preservation. It is desired to utilize a metal having a low melting point in comparison with a combination of dissimilar metals, which are hardly separated, and also a metal requiring a high energy for producing, such as steel plate and an aluminum. In the Nikkei Mechanical Dec. 9, 1996, Vol.495; the Nikkei Mechanical March 1998,Vol.522; the Kogyo Zairyo May 1998, Vol.46, No.5, and the Kogyo Zairyo October 1998, Vol.46, No.10, a thixomolding method, by which a magnesium alloy being a representative metal having a low melting point, is subjected to injection molding, is disclosed. The thixomolding method is a coined word derived from thixotropy and injection molding, wherein the thixomolding method means a semi-molten metal injection molding method developed in U.S.A. Grain-like chips, made of a magnesium alloy ingot(igt) are used as a low material to inject into a metal mold of a product like injection molding of a plastic. Thereafter, a molded object is taken out of the metal mold. The magnesium alloy to be injected is changed depending on a use such that the magnesium alloy is in a liquid phase or contains an arbitrary solid.

FIG. 40 illustrates a structure of a thixomolding device as an injection molding device. Numerical reference 101 designates a hopper for throwing a raw material to a feeder 105; numerical reference 107 designates an electrical heater, i.e. ceramic band heater, inside which a screw 103 is rotated; numerical reference 102 designates a cylinder heated by the electrical heater; numerical reference 104 designates a back flow prevention ring; numerical reference 106 designates an inactive atmosphere; numerical reference 109 designates a metal mold of a product; numerical reference 112 designates a nozzle for injecting a molten metal accumulated in a reservoir 122 from an injection molding machine by a rapid shot system; and numerical reference 121 designates a rotary drive.

In FIG. 40, a pellet-like magnesium alloy is thrown from the hopper 101, and a part of the magnesium alloy, measured by the feeder 105, is thrown into the cylinder 102. An outer peripheral portion of the cylinder is heated by the electric heater 107, i.e. the ceramic band heater, to make a semi-fusion magnesium alloy, wherein the semi-fusion magnesium alloy is separated from the magnesium alloy in the feeder by the inactive atmosphere 106. Only an injected amount of the magnesium alloy is measured and supplied from the feeder to appropriately control the amount of the semi-fusion magnesium alloy. However, the injected amount and a supplied amount do not completely match, unlike resin molding. The magnesium alloy thrown into the cylinder 102 is forward conveyed, made to be like slurry, and injected by a rotation of the screw 103. Thixomolding uses characteristics of thixotropy of a magnesium alloy. A magnesium alloy exists in a condition that dendrites in a solid phase are connected like branches in a solid-liquid coexisting state. Accordingly, a viscosity is high in this state. When a shear force is continuously applied by the rotating screw 103, the dendrites are cut and minutely powdered, whereby fluidity is enhanced.

FIG. 41 illustrates a structure of a nozzle of the molding machine. Numerical reference 110 designates a coagulate plug, which prevents the semi-fusion magnesium alloy 111 from flowing out of the tip nozzle 112; and numerical reference 113 designates a gate of the metal mold 109. The tip nozzle 112 is shaped like a projected hemisphere. An entrance of the gate 113 of the metal mold 109 is shaped like a recessed hemisphere having an inlet a little larger than an outlet of the tip nozzle 112. The tip nozzle 112 and the inlet of the gate 113 are in contact with each other and combined on their hemispheres. If the contact is not tight, there is a possibility that the semi-fusion magnesium alloy is brown into the atmosphere. Therefore, it is necessary to carefully adjust the contact. At a top of the semi-fusion magnesium alloy 111, a lump formed by a metal, referred to as the coagulate plug 110, is located. When the semi-fusion magnesium alloy is injected, the coagulate plug is projected and an injection is finished within a very short time of several dozens of microseconds through several milliseconds. FIG. 42 illustrates a state that the injection molding machine is separated from the metal mold after completing the injection. A metallic piece chokes the gate portion 113, and a coagulate plug 110 is left at a separated portion.

Meanwhile, a propeller fan, supplied for an ordinary use, is made of a plastic. When a propeller fan is used where a fire is used as in a kitchen, or where is a high temperature, the propeller fan is made of a metal. A method of producing the propeller fan made of a metal is such that a thin steel plate, a thin aluminum plate, or the like is used; an impeller is formed by monolithical drawing; and a rotation shaft, formed as another component, is joined to and fixed to the fan. Therefore, the impeller formed by monolithically drawing a thin steel plate is abruptly twisted at a hub of a vane. Accordingly, there is a problem in a strength of the propeller fan such that the drawn portion is cracked. Further, a dimensional accuracy of the fan is not sufficient because of a phenomenon called spring-back, by which an once twisted shape returns a little to an original shape. Further, although a propeller fan made of a thin aluminum plate is thin and light, a material cost becomes high. Because a vane cannot be abruptly twisted in comparison with that made of a steel plate, an ideal shape of the fan cannot be realized. Thus a characteristic of the thin aluminum plate does not ideally match for the propeller fan. Further, because a rotation shaft is a separate component, a time for producing the propeller fan is long.

Further, a large-sized propeller fan is constructed such that vanes and a rotation shaft are separate components. However, the vanes are not monolithically formed, and a plurality of metallic fans are fixed to the rotation shaft by a part called a spider, which is formed by a steel plate thicker than the vanes, or the like. Therefore, in case of the large-sized propeller fan made of a steel plate, of which material is a low cost, the weights of components are increased; and a balancing work is required because of insufficient balancing of the vanes, whereby the large-sized propeller fan is not suitable for a high revolution because of a low natural frequency of the vanes. Further, a time for producing a large-sized propeller fan is long because a rotation shaft is the separate component.

A conventional example of a shape of a propeller fan is as follows.

Japanese Unexamined Patent Publication JP-A-10-47298, and Japanese Unexamined Patent Publication JP-A-7-18991 disclose a structure that a hollow portion is provided in a vane made of a resin for reducing a noise. However, there is a problem that vanes of the fans are deformed under a high temperature running condition because a material of the fan is the resin.

Japanese Examined Utility Model Publication JP-B-3-54337 discloses a structure that a fan is formed by monolithically drawing a thin steel plate, a thin aluminum plate, or the like; and the fan is joined to a rotation shaft made of, for example, an aluminum die-cast, for connecting a flange of a boss in use of a separate component such as rivets. However, in the fan formed by monolithically drawing the thin steel plate, there is a problem of a strength because a twisted portion is cracked when the hub of the fan is abruptly drawn. Further, Japanese Examined Utility Model Publication JP-B-5-45838 and Japanese Examined Utility Model Publication JP-B-7-23600 disclose a technique that a material of an impeller is similar to that described above and a spider is used for assembling.

Japanese Patent No. 1577205 discloses a structure that a shape of vanes of a fan is inconformity with a centrifugal force for controlling a hydrodynamic boundary layer and for making a noise low in use of the centrifugal force. However such a shape is very disadvantageous in terms of a stress.

Japanese Unexamined Patent Publication JP-A-9-228995 and Japanese Patent Publication No. 2566183 disclose a structure that an air-current separation prevention rib is located on a negative pressure side of a fan to decrease a noise.

For example, Japanese Unexamined Patent Publication JP-A-10-205493 discloses a shape of a propeller fan made of a magnesium alloy and a method of producing the propeller fan. Further, "Magnesium Dokuhon by author Shotarou Morozumi, published by Karosu Shuppan" discloses an axial fan made of a magnesium alloy, which is practically used as a fan, i.e. an impeller, of a cooling tower in around year 1950. A similar fan is practically used as a cooling fan made by a die-cast method in a technical field of automobile. Further, many fans made of an aluminum die-cast and so on are practically used.

However, the conventional technique has problems that a balancing work is necessary to deal with an increased weight in a structure that the main plate having the rotation shaft, the side plate on the inlet side, and the plurality of vanes are fixed by caulking or by a similar method thereto, and that a wind noise and a mechanical noise of a rotating object having many recesses and protrusions formed in caulked portions are large. Further, there are problems that a material cost is high and recycling is difficult in consideration of the global atmosphere in case of using an aluminum and a plastic. Meanwhile, in a thixomolding method, by which a magnesium alloy being a representative of a melt with a low melting point is subjected to injection molding, although reactivity between a magnesium alloy and an iron of a metal mold material is small, a shrinkage factor of a magnesium alloy is small in comparison with a plastic. Therefore a mold release agent, which is not ordinarily used in plastic molding, should be coated on the metal mold for releasing the magnesium alloy from the metal mold. Therefore, leaves of the metal mold are about $^{25}/_{1000}$, i.e. about 1.5°, wherein in plastic molding, leaves are about $^{5}/_{1000}$. Accordingly, there is a problem that the fan is not satisfactorily performed because of narrow intervals and no interval between vanes at root portions of the vanes at time of shaping a number of vanes like a cylinder, e.g. a sirocco fan, because dimensions of the roots become very thick when the leaves are increased. Further, there is a problem that it is difficult to practically use the fan because a magnesium alloy is hard to be uniformly filled to a number of vanes to make the vanes in order to complete injection within a short time. In a thixomolding method, it is not practical to charge a molten metal to form a complicated shape like a fan, and there is a problem to set up the metal mold, for example, in releasing the mold. Accordingly, there is a problem that a time and a cost are increased in producing the fan. Further, similar problems to those described above exist in a magnesium die-cast method.

Meanwhile, there are problems similar to those described above in the conventional technique of forming an impeller by monolithically drawing vanes, made of a thin steel plate, a thin aluminum plate, or the like, and joining by caulking a rotation shaft as a separate component with the impeller.

SUMMARY OF THE INVENTION

It is an object of the present invention to solve the above-mentioned problems inherent in the conventional technique and to provide a sirocco fan produced by metal molding, such as injection molding, out of a fusible alloy, such as magnesium. Further, it is another object of the present invention to provide a method of molding a molten metal for the sirocco fan and a device for molding the molten metal for the sirocco fan, which method and device have high reliability in a simple structure at a low cost. Further, another object of the present invention is to provide a product made of a easily-recycled-material by a low-cost-device using a smaller energy for recycling in consideration of the global atmosphere preservation. Further, another object of the present invention is to provide a technique for easily producing a complicated thin plate structure, such as an impeller at a low cost.

Further, it is another object of the present invention to provide a propeller fan produced by metal molding, such as injection molding, out of a fusible alloy, such as magnesium. Another object of the present invention is to provide a molten metal molding method for producing the propeller fan and a device for producing the propeller fan by fusion injection molding, which method and device have high reliability using a simple structure at a low cost.

According to a first aspect of the present invention, there is provided a sirocco fan comprising: an impeller cylindrically formed by joining a plurality of vanes to an outer periphery of a main plate shaped like a flat plate or a main plate having a recess at the center thereof; a stiffening ring for supporting a side opposite to the joining side; and a shaft which is located in the center of the main plate for supporting the impeller, rotated by a motor, and monolithically molded with the impeller and the stiffening ring by melting a metal, wherein the shaft is at least one of a gate portion, which is a flow path of the metal to the impeller, of a metal mold, or a receiver for accommodating a coagulate metal.

According to a second aspect of the present invention, there is provided the sirocco fan, wherein the shaft is formed by removing a tip of the receiver, in which the coagulate metal exists, or an injection side of the gate.

According to a third aspect of the present invention, there is provided a sirocco fan comprising: an impeller cylindrically formed by joining a plurality of vanes to an outer periphery of a main plate, which is shaped like a flat plate or a main plate having a recess at a center thereof; a shaft located in the center of the main plate to support the impeller and rotated by a motor; a stiffening ring covering an outer periphery of the vanes for supporting an inlet side, which is opposite to the joining side of the vanes and monolithically molded with the vanes; and a connecting portion with an overflow portion, which is located in an outer periphery of the stiffening ring, for accumulating a flowing metal charged to the impeller and the stiffening ring at time of monolithically molding the impeller and the stiffening ring by melting the metal, which connecting portion is removed after molding.

According to a fourth aspect of the present invention, there is provided a sirocco fan comprising: an impeller shaped like a cylinder by joining a plurality of thin vanes to a main plate; and a stiffening ring for supporting an inlet side, which is opposite to the joining side of the vanes, wherein the main plate shaped like a flat plate or having a recess in a center thereof, the plurality of vanes in an outer periphery of the main plate, and the stiffening ring are monolithically molded by melting a metal.

According to a fifth aspect of the present invention, there is provided a sirocco fan comprising: an impeller shaped like a cylinder by joining a plurality of vanes to an outer periphery of a main plate shaped like a flat plate or having a recess at a center thereof; and a stiffening ring for supporting an inlet side, which is opposite to the joining side of the vanes, wherein the impeller and the stiffening ring are monolithically molded by melting a metal, and dimensions of connecting portions of the vanes with the main plate are partly larger than dimensions of the other parts of the vanes.

According to a sixth aspect of the present invention, there is provided the sirocco fan, wherein a chamfer larger than the thickness of a tip of the vanes is formed in the connecting portions between the vanes and the main plate.

According to a seventh aspect of the present invention, there is provided a sirocco fan comprising: an impeller shaped like a cylinder by joining a plurality of vanes to an outer periphery of a main plate, shaped like a flat plate or having a recess at a center thereof; a stiffening ring for supporting a side, which opposite to the joining portion of the vanes; and a shaft located in the center of the main plate for supporting the impeller, rotated by a motor, and monolithically molded by melting a fusible metal with the impeller and the stiffening ring, wherein a mold ring thinner than the stiffening ring is located on an entire surface of an outer periphery of the impeller at time of molding, and the mold ring is removed after molding.

According to an eighth aspect of the present invention, there is provided a sirocco fan comprising: an impeller shaped like a cylinder by joining a plurality of vanes to an outer periphery of a main plate, shaped like a flat plate or having a recess at a center thereof; a stiffening ring for supporting a side opposite to the vanes; and a shaft located in the center of the main plate for supporting the impeller, rotated by a motor, and monolithically molded by welding a metal with the impeller and the stiffening ring, wherein the shaft is at least one of a gate of a metal mold, which is molded in a flow path of the metal to the impeller and a receiver for accommodating a coagulate metal, and a mold ring thinner than the stiffening ring is located on an entire surface of an outer periphery of the impeller, which mold ring is removed after molding.

According to a ninth aspect of the present invention, there is provided a sirocco fan comprising: an impeller shaped like a cylinder by joining a plurality of vanes to an outer periphery of a main plate, shaped like a flat plate or having a recess in a center thereof; a stiffening ring for supporting a side opposite to the joining portion of the vanes; and a shaft located in the center of the main plate for supporting the impeller, rotated by a motor, and monolithically molded by melting a metal with the impeller and the stiffening ring, wherein the stiffening ring is located on an entire peripheral surface of the impeller at time of molding, and a part of the stiffening ring, other than a portion opposite to the joining side between the main plate and the vanes, is removed after molding.

According to a tenth aspect of the present invention, there is provided the sirocco fan, wherein a portion of the stiffening ring opposite to the joining side of the main plate and the vanes, and a portion of the stiffening ring at a center with respect to directions of the shaft of the impeller are left after molding.

According to an eleventh aspect of the present invention, there is provided the sirocco fan, wherein an inner diameter of the stiffening ring or inner diameters of both of the stiffening ring and the mold ring are little larger than an outer diameter of the impeller.

According to a twelfth aspect of the present invention, there is provided the sirocco fan, wherein an outer diameter of the impeller, from which one or both of the mold ring and the stiffening ring are removed, is the same on a side of the main plate of the impeller and on a side of the stiffening ring of the impeller.

According to a thirteenth aspect of the present invention, there is provided the sirocco fan, wherein joining portions of one or both of the mold ring and the stiffening ring to the impeller are rounded.

According to a fourteenth aspect of the present invention, there is provided the sirocco fan, wherein the metal melted for monolithically molding the fan is a magnesium alloy.

According to a fifteenth aspect of the present invention, there is provided a fusion metal molding method for molding a molded object of a sirocco fan by melting and injecting at least a part of a metal from a metal molding machine into a metal mold comprising steps of: injecting a molten metal from a gate positioned at a shaft for monolithically molding the shaft, which is located in a center of a main plate for supporting an impeller, and rotated by motor; and forming the shaft by removing a coagulate metal coagulated and blown off by a nozzle of the metal molding machine from the gate.

According to a sixteenth aspect of the present invention, there is provided a fusion metal molding method for producing a sirocco fan, which is molded in use of a metal mold having a shape of a shaft hole, for molding a molded object of the sirocco fan by melting and blowing off at least a part of a metal from a metal molding machine into a metal mold comprising steps of: injecting a molten metal from a shaft, which is located in a center of a hub for supporting the impeller and rotated by a motor in order to monolithically molding the shaft and the impeller; and forming the shaft hole by removing a part of a gate after molding the molded object by injecting the molten metal.

According to a seventeenth aspect of the present invention, there is provided a fusion metal molding method for producing a sirocco fan including an impeller shaped like a cylinder by joining a plurality of vanes to a stiffening ring for supporting a side opposite to the joining side of the vanes comprising steps of: connecting a nozzle of a metal molding machine at a position of a shaft in a center of a main plate, which is arranged on one side of the impeller, and injecting a metal, at least a part of which is melted, to form a molded object; and charging the injected metal into the vanes and the stiffening ring, and bringing thus passed metal into an overflow portion, which is connected with the stiffening ring, for accumulating the passed metal.

According to an eighteenth aspect of the present invention, there is provided a fusion metal molding method for producing a sirocco fan including an impeller shaped like a cylinder by joining a plurality of vanes and a stiffening ring for supporting a side opposite to the joining portion of the vanes comprising steps of: connecting a nozzle of a metal molding machine at a position of a shaft in a center of a main plate, which is arranged on one side of the impeller, and injecting a molten metal, at least a part of which is melted, to form a molded object; filling the injected metal into the vanes, the stiffening ring, and a mold ring located in an outer periphery of the impeller; and removing the mold ring.

According to a nineteenth aspect of the present invention, there is provided a fusion metal molding device for producing a sirocco fan including a metal molding machine, which melts at least a part of a metal and blows off from a nozzle, and a metal mold for molding the blown-off metal into the sirocco fan, comprising: a receiver for accommodating a gate of the metal mold, the gate is a flow path of the metal into the impeller positioned at a shaft, which shaft is positioned in a center of main plate of the sirocco fan, rotated by a motor, and monolithically molded with the impeller by welded the metal, wherein dimensions of joining portions of the vanes with the main plate, which is shaped like a flat plate or has a recess in the center thereof, is partly larger than dimensions of the other portions of the vanes.

According to a twentieth aspect of the present invention, there is provided the fusion metal molding device of a sirocco fan, wherein, in a gap between a part of the metal mold on an outer periphery side of the vanes and a part of the metal mold on an inner periphery side of the vanes, leaves are provided for enabling to separate the parts on the outer periphery side and on the inner periphery side of the metal mold by increasing an outer diameter of the fan on a side of the stiffening ring supporting an inlet side, which is opposite to the jointing side of the vanes, the outer diameter is more than a cylindrical outer diameter of the joining portion of the vanes with the main plate.

According to a twenty-first aspect of the present invention, there is provided the fusion metal molding device of a sirocco fan, wherein the gap between the part of the metal mold on the outer periphery side and the part of the metal mold on the inner periphery side is small enough to form a burr, which is squeezed-out at time of molding, by a shot blast.

According to a twenty-second aspect of the present invention, there is provided the fusion metal molding device of a sirocco fan, further comprising: a partial metal mold shaped like a key and arranged at a key way of the shaft of the molded object in the metal mold, to which the metal for the gate as the flow path of the metal and for the receiver accommodating the coagulate metal is charged.

According to a twenty-third aspect of the present invention, there is provided the fusion metal molding device of a sirocco fan including a metal molding machine, which melts at least a part of a metal and blows off the metal from a nozzle, and a metal mold for molding a blown-off metal to mold the sirocco fan, comprising: a plurality of gate inlets of the metal mold, which inlets are flow paths of the metal to the sirocco fan and positioned at a thin plate-like main plate at an outer periphery of a shaft, which is located in a center of a main plate for supporting an impeller and rotated by a motor; and a thick portion in the main plate, which is formed on a back surface of the main plate at a position facing a plurality of gates and thicker than other portions of the main plate in an area larger than a diameter of a gate.

According to a twenty-forth aspect of the present invention, there is provided the fusion metal molding device of a sirocco fan, wherein a connecting portion of the main plate connected to the inlets of the plurality of the gates is in a shape of a recess.

According to a twenty-fifth aspect of the present invention, there is provided a propeller fan comprising: an impeller formed by monolithically molding an outer periphery of a hub in a cylindrical shape or a cone-like shape, and a plurality of vanes; and a shaft, which is located in a center of the hub for supporting the impeller, rotated by a motor, and monolithically molded with the impeller by melting a metal, wherein the shaft is at least one of a gate of a metal mold, which gate is molded as a flow path of the metal to the impeller at time of molding, and a receiver for accommodating a coagulate metal.

According to a twenty-sixth aspect of the present invention, there is provided a propeller fan, wherein the shaft is formed by removing an injection side of the gate or a tip of a portion where the coagulate metal exists in the receiver.

According to a twenty-seventh aspect of the present invention, there is provided a propeller fan, wherein the thickness of an inner peripheral portion of the vanes adjacent to a joining portion of the vanes to the hub is thicker than the thickness of an outer peripheral portion of the vanes and less than twice of the thickness of the inner peripheral portion of the vanes.

According to a twenty-eighth aspect of the present invention, there is provided a propeller fan comprising: a spider including a shaft, which is located in a center of the propeller fan for supporting an impeller, and rotated by a motor; and vanes joined to the spider and being thinner than the spider, wherein the shaft is at least one of a gate of a metal mold, which gate is molded as a flow path of a metal, at time of molding, to the impeller and a receiver for accommodating a coagulate metal, the gate or the receiver is located on an inlet side of the spider, the receiver or the gate is located on an outlet side of the spider, and the shaft is formed by processing the gate or the receiver.

According to a twenty-ninth aspect of the present invention, there is provided the propeller fan, wherein the metal for monolithically molding by melting is a magnesium alloy.

According to a thirtieth aspect of the present invention, there is provided a propeller fan comprising: an impeller formed by monolithically molding an outer peripheral portion of a hub in a cylindrical shape or in a cone-like shape and a plurality of vanes; and a shaft, which is located in a center of the hub for supporting the impeller, rotated by a motor, and monolithically molded with the impeller by melting a metal, wherein the shaft is at least one of a gate of a metal mold, which gate is molded as a flow path of the metal to the impeller at time of molding, and a receiver for accommodating a coagulate metal, and a recess is formed on an inlet side of the hub for processing a plurality of pin gates of a gate.

According to a thirty-first aspect of the present invention, there is provided the propeller fan, wherein the number of the recesses is the number of vanes of the impeller or more.

According to a thirty-second aspect of the present invention, there is provided the propeller fan, wherein diameters of the gate joined to the hub, of a plug catcher, and of a coagulate plug are smaller in this order.

According to a thirty-third aspect of the present invention, there is provided the propeller fan, wherein an air flow separation prevention rib, which protrudes in an inlet side of the impeller, is monolithically formed with the impeller.

According to a thirty-forth aspect of the present invention, there is provided the propeller fan, wherein the thicknesses of the vanes of the impeller are uniform.

According to a thirty-fifth aspect of the present invention, there is provided a molten metal molding method for producing a propeller fan as a molded object, formed by melting at least a part of a metal from a metal molding machine and blowing it from a nozzle to a metal mold comprising steps of: injecting a molten metal from a shaft, which is located in a center of a hub for supporting an impeller, rotated by a motor, and monolithically molded with the impeller by melting the metal; and forming the shaft by removing a coagulate metal, coagulated in and blown off from the nozzle, out of a gate after molding the molded object.

According to a thirty-sixth aspect of the present invention, there is provided a fusion metal molding method for producing a propeller fan, molded in use of a metal mold having a shape of a shaft hole for forming a molded object of the propeller fan by melting at least a part of a metal from a metal molding machine, and blowing it off from a nozzle into the metal mold, comprising steps of: injecting the molten metal from a shaft, which is located in a center of a hub for supporting an impeller, rotated by a motor, and formed by monolithically molding with the impeller by melting the metal; and forming the shaft hole by removing a part of a gate after molding the molded object by injecting the molten metal.

According to a thirty-seventh aspect of the present invention, there is provided a molten metal molding method for producing a propeller fan, formed by monolithically molding an outer peripheral portion of a hub and a plurality of vanes, comprising steps of: connecting a nozzle of a metal molding machine at a position of a shaft in a center of the hub and injecting the metal, at least a part of which is melted, into a molded object; charging the injected metal into an overflow portion connected to the impeller and an outer peripheral portion of the vanes of the impeller; and removing the overflow portion.

According to a thirty-eighth aspect of the present invention, there is provided a molten metal molding device for producing a propeller fan including a metal mold machine for melting at least a part of a metal and blowing it off from a nozzle, and a metal mold for molding the propeller fan in use of thus blown-off metal, comprising: a gate of the metal mold, which gate is molded as a flow path of the metal to an impeller and positioned in a shaft, which is located in center of a hub of the propeller fan for supporting the impeller, rotated by a motor, and formed by monolithically molding with the impeller by melting the metal, or a receiver for accommodating a coagulate metal; a fixed part of the metal mold positioned on a side of the gate with respect to the molded object; and a movable part of the metal mold positioned on a side opposite to the gate side.

BRIEF DESCRIPTION OF THE DRAWINGS

A more complete appreciation of the invention and many of the attendant advantages thereof will be readily obtained as the same becomes better understood by reference to the following detailed description when considered in connection with the accompanied drawings, wherein:

FIG. 22*a* illustrates a molding process by a hot chamber method;

FIG. 22*b* illustrates the molding process by the hot chamber method;

FIG. 22*c* illustrates the molding process by the hot chamber method;

FIG. 22*d* illustrates the molding process by the hot chamber method;

FIG. 23 is a cross-sectional view of a sirocco fan in a state of processing a gate according to Embodiment 7 of the present invention;

DETAILED DESCRIPTION OF THE PREFERRED EMBODIMENTS

A detailed description will be given of preferred Embodiments of the present invention in reference to FIGS. 1 through 38 as follows, wherein same numerical references are used for the same or similar portions and description of these portions is omitted.

Embodiment 1

Figure 1:
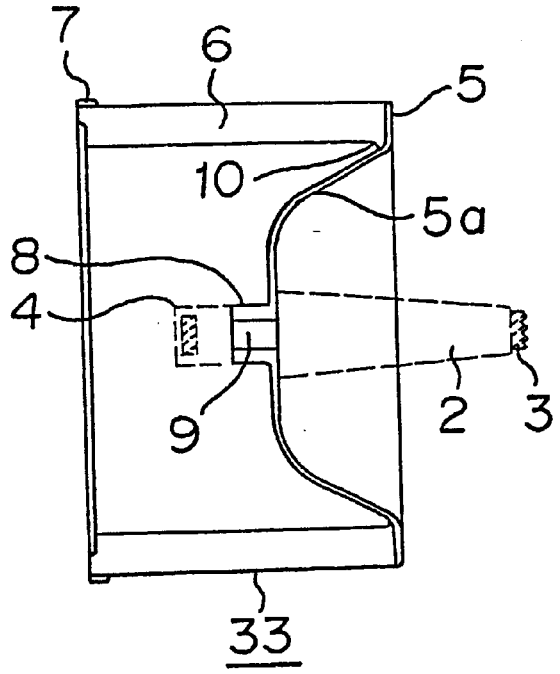
FIG. 1 is a cross-sectional view of a sirocco fan in a state of processing a gate according to Embodiment 1 of the present invention.
Figure 2:
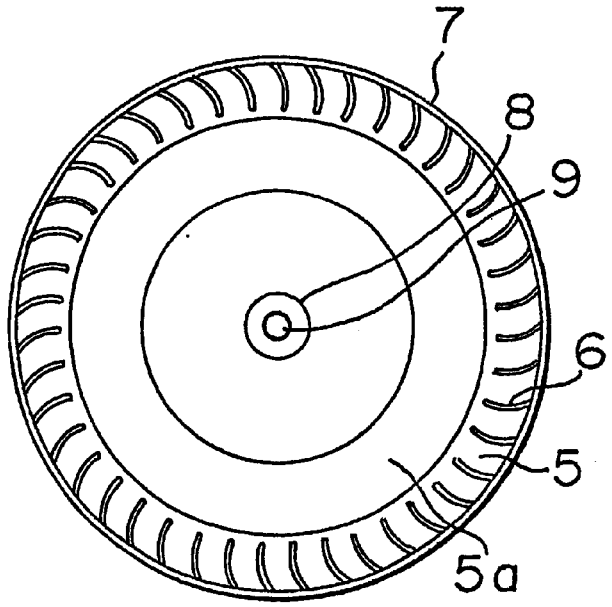
FIG. 2 is a front view of the sirocco fan in the state of processing the gate according to Embodiment 1 of the present invention.
Figure 3:
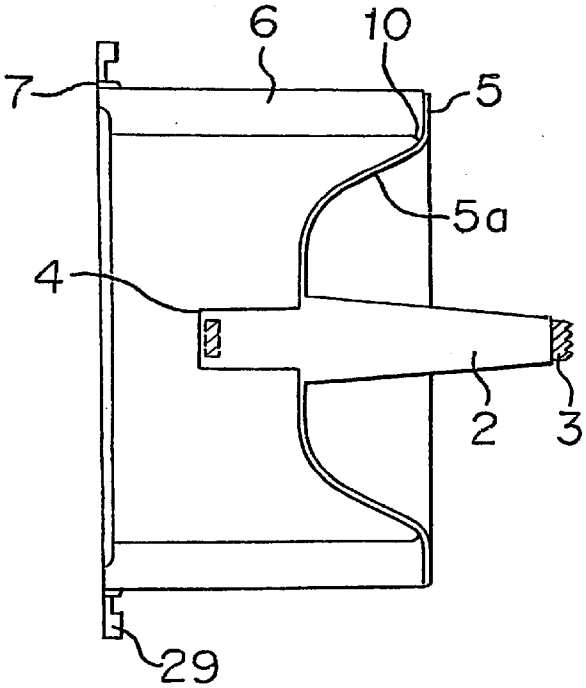
FIG. 3 is a cross-sectional view of the sirocco fan before processing the gate according to Embodiment 1 of the present invention.

FIGS. 1 through 3 explain a case that an impeller of a sirocco fan is produced according to Embodiment 1 of the present invention. FIG. 1 is a cross-sectional view of the sirocco fan in a state of processing a gate. FIG. 2 is a front view thereof. FIG. 3 is a cross-sectional view thereof. In figures, numerical reference 5 designates a main plate having a choked portion 5*a* shaped like a recess in a center thereof. Numerical reference 6 designates a plurality of vanes formed in a cylindrical shape, the vanes fabricate an impeller 33. Numerical reference 7 designates a stiffening ring positioned on an opposite side to the main plate 5 and monolithically formed with the vanes 6 for supporting an outer periphery of the vanes. Numerical reference 8 designates a boss having a rotation shaft hole 9, which is processed after molding. Numerical reference 2 designates a gate, which is an inlet of a molten metal injected from an injection molding machine to a metal mold, which is charged by the molten metal flowing from the boss 8 to the impeller 33. Numerical reference 3 designates a coagulate metal torn at a nozzle of the injection molding machine. Numerical reference 4 designates a receiver for accommodating the coagulate metal blocking an outlet of the nozzle. Numerical reference 10 designates a bending portion, at which the vanes 6 are joined to the main plate 5, for making the molten metal easily flow by increasing an inner peripheral side of the vanes. Numerical reference 29 designates an overflow circuit of the metal mold. The sirocco fan is produced by vertically joining the plurality of vanes to an outer periphery of the main plate, which has the choked portion shaped like a corn in a center thereof, on the inlet side, and by monolithically molding the main plate, the vanes, and the stiffening ring covering the outer periphery of the vanes.

Figure 26:
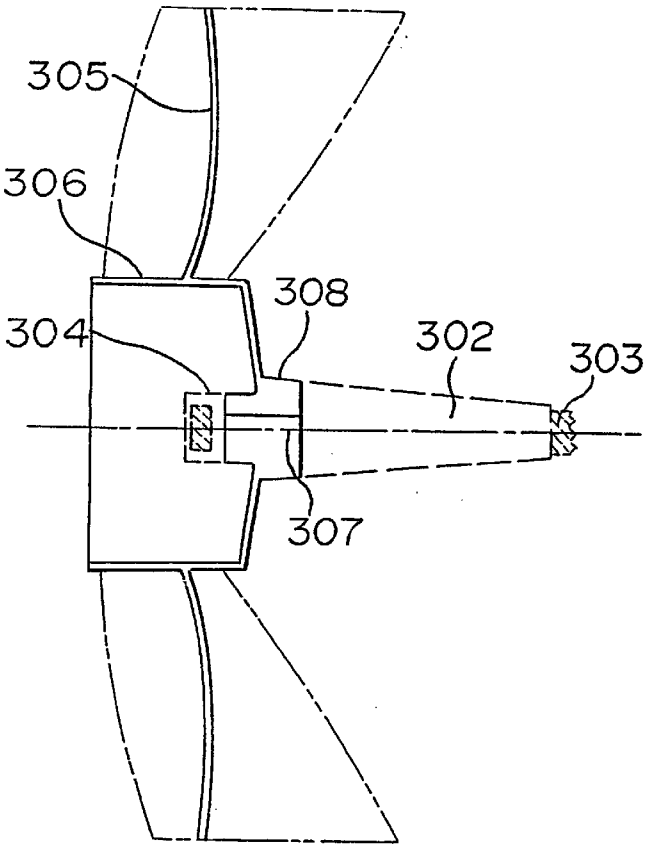
FIG. 26 is a cross-sectional view of a propeller fan in a state of processing a gate according to Embodiment 8 of the present invention.

In a structure illustrated in FIGS. 1 through 3, the impeller 33 is rotated by a motor, illustrated in FIG. 26, directly connected to the rotation shaft hole 9. Thus, the fan takes an air from a side of an inner diameter of the stiffening ring and blows it off to a side of an outer diameter of the stiffening ring by the vanes 6 joined to the main plate. A shaft for supporting and rotating the impeller 33 is formed by removing the gate 2 formed by the injection molding and the receiver 4 for accommodating the coagulate metal, which gate and coagulate metal correspond to an area surrounded by broken lines in FIG. 1. If an outer diameter of the boss 8 is designed to be same as an outer diameter of the receiver 4, the shaft is simply formed by cutting a tip of the receiver 4 by mechanical processing and by processing the rotation shaft hole. In cases that shaft is required to be long and a diameter of the shaft is required to change, it is possible to freely design by properly selecting dimensions of the gate of the metal mold. By positioning the gate in a corn-like shape in a center of the main plate, it is possible to effectively use shapes of the gate and the receiver, to which an unnecessary coagulate metal portion disposed, whereby a material can be saved and steps of the process are reduced in producing the sirocco fan. Further, it is possible to safely process the sirocco fan by reducing scraps of magnesium. Although the case that the boss 8 is formed by the receiver 4, when the motor is positioned on the inlet side of the fan, i.e. a side of the receiver, and therefore the receiver becomes an obstacle, the receiver may be removed, and instead the gate may be processed to form the boss.

One sample of the sirocco fan illustrated in FIGS. 1 through 3 has features that the outer diameter of the impeller is 180 mm at a position of the stiffening ring, the width of the impeller is 110 mm, the thickness of each vane is 1.0 mm at a tip, leaves of each vane are $^{7}/_{1000}$, the thickness of each vane at a root thereof, i.e. the thickness on a side of the main plate, is 2.54 mm, the number of the vanes is 43, the thickness of the main plate is 2.0 mm, leaves of an outer periphery of the impeller is $^{10}/_{1000}$, and the outer diameter of the vanes at a position of the main plate is 177.8 mm. An outer peripheral part of the metal mold is in contact with an inner peripheral part of the metal mold are in contact at the outer peripheral portion of the vanes. Therefore, it is necessary to separate the parts of the metal mold by providing a gap between the outer peripheral part and the inner peripheral part of the metal mold by setting the leaves. As a result, dimensions of the outer periphery are different along a longitudinal direction of the vanes. Although there is no inconvenience in this sample, a strength of joining portion between the stiffening ring and the vanes is increased for further increasing a rigidity of the fan. The thickness of each vane at the tip is changed to 1.2 mm, the leaves of the vanes is changed to $^{6}/_{1000}$, and the thickness of the each vane at the root thereof is changed to 2.52 mm while keeping dimensions of other portions the same.

The bending portion 10 is formed in the metal mold for facilitate the molten metal flowing from the gate to the vanes through the main plate, which bending portion is in the joining portion between the main plate and the vanes. Further, for avoiding an underfill and a mold cavity, which are caused by a defect that an injection quantity and a supply quantity in a thixomolding method are not completely match, the overflow circuit for absorbing an excessive molten metal is located in a tip of the stiffening ring. Therefore, the molten metal rapidly and evenly flows into various portions of the plurality of thin vanes, the stiffening ring, and so on through the main plate from the gate, and is accurately filled in the shaft through the stiffening ring of a product, whereby a finely molded object is obtainable. Because the overflow circuit is partly connected to the stiffening ring, it is possible to easily remove the overflow circuit from the stiffening ring after molding. After connecting the overflow circuit to the stiffening ring, a trace is ordinarily observed because tools and so on are in contact with the thin connecting portion at time of removing the metal mold depending on a method of removing the metal mold. However, when the fan is coated, the trace is covered by the coating. By a direct gate structure, in which the nozzle of the injection molding machine, the gate being the shaft as a center of rotation, and the sirocco fan are directly connected, it is possible to charge the magnesium alloy uniformly from a center of the shaft to a peripheral portion, in which the plurality of vanes are formed in the cylindrical shape. Such an effect is not attained in use of a gate located in a local portion such as an outer peripheral side of the main plate.

In the molding machine used for thixomolding, because the magnesium alloy is heated to be under about 600° C., a metallic material having an excellent heat resistance and low reactivity with the molten metal is used for a cylinder and a screw. Further, because coagulation of the metal is rapid, it is necessary to increase an injection rate. Therefore, a hydraulic system for driving a screw has a large capacity. Further, because a metal is injected in a semi-fusion state in thixomolding, the molding machine is used in a state that a temperature is lower than a die-cast. When a specific strength, i.e. a value obtained by dividing a strength by relative density of a magnesium alloy AZ91D, is compared with those of the other materials used for an impeller, the magnesium alloy is 154, an aluminum alloy is 106, and carbon steel is 80, wherein the magnesium alloy is most suitable for a body of rotation in terms of the strength because it has the largest specific strength and is light. However, an alloy having a low melting point and a metal having a high melting point, which does not require a large energy in producing not like aluminum are suitable for the present invention. Thus, it is possible to obtain a structure, by which a molten metal is uniformly flown into various portions of a product having a thin plate and into a complicated shape like a sirocco fan formed by arranging a plurality of thin plates having a thickness of about 1 through 2 mm, wherein such a sirocco fan can not be produced by an aluminum die-cast method. According to the present invention, it is possible to produce a large number of large-sized products through a large number of small-sized products at a low cost.

Figure 4:
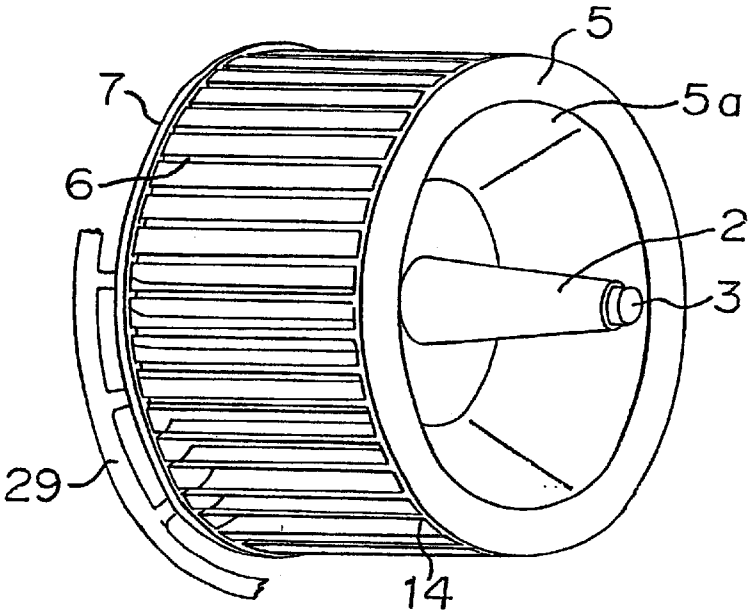
FIG. 4 is a perspective view of the sirocco fan before processing the gate according to Embodiment 1 of the present invention.

FIG. 4 is a perspective view of a structure illustrated in FIG. 3. Numerical reference 2 designates a first spool as a gate. Numerical reference 14 designates a chamfer. Numerical reference 29 designates a part of the overflow circuit, partly connected to the outer periphery of the stiffening ring 7. Because it is necessary to uniformly charge the magnesium alloy toward the plurality of parallely arranged vanes 6 within a very short time, an area filled with the molten metal in the metal mold should be drawn to be the vacuum by serving this vacuum portion as the overflow circuit and an outer periphery portion of the stiffening ring 7. It is possible to relatively easily remove a thin metal partly being a burr, which is flown out of the vacuum portion, and to make a structure of the metal mold simple. Further, by locating such an overflow portion, it is possible to prevent a mold cavity and an underfill, in both of which the molded metal is not partly charged, from generating, whereby quality of the molded object is improved. In the shape of the sirocco fan illustrated in FIG. 4, since the vanes are arranged like a cylinder, the vanes are monolithically molded with the stiffening ring outward joined, the outer peripheral part of the metal mold of the vanes is different from the inner peripheral part of the metal mold, and the inner part of the metal mold is inserted among the vanes, it is necessary to forcibly push out an end surface of the inner part of the metal mold on a joining side to the stiffening ring for releasing the metal mold. After releasing from the metal mold, the first spool 2 in the gate and a plug catcher 4 illustrated in FIG. 4 are processed to be the shaft, and the boss 8 having the rotation shaft hole 9 connected to a rotation shaft of the motor is formed as illustrated in FIG. 1. Since the rotation shaft is processed in a later step, it is possible to arbitrarily determine a shape of, for example, the shaft hole, wherein a usage is widened by selecting fans directly connected to various motors. When the number of revolution is doubled using an unchanged number of the vanes, an air quantity becomes twice as much, a pressure becomes four times as much, and a shaft power becomes eight times as much. On the other hand, although an output from the motor is the same as the shaft power, a diameter of the rotation shaft hole, i.e. an outer diameter of the motor shaft, is generally changed when the output is increased. This means that it is possible to easily produce the fans, in which shapes of impellers are the same and inner diameters of rotation shaft holes are different to deal with different outputs. Further, it is possible to fit shafts having various shapes by processing only gates, whereby various connections can be easily selected for driving fans, and the fans are applicable to a large number of uses.

Meanwhile, a method of removing the overflow circuit 29 is generally a method by a manual operation, a method of cutting by a press machine in use of a trimming metal die, and so on. When the number of production is small, a manual operation is generally adopted. After attaching a trimming upper die and trimming lower die to the press machine, a product having the overflow circuit 29, for example the fan illustrated in FIG. 3, is mounted on the lower die, and the trimming upper die is lowered to press the outer peripheral portion of the impeller, whereby the overflow circuit 29 can be removed.

Figure 5A:
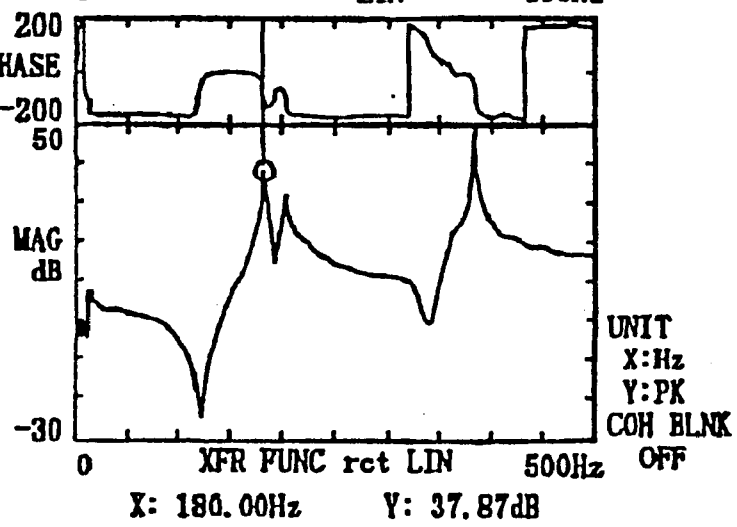
FIG. 5*a* shows a characteristic of a natural frequency of the sirocco fan according to Embodiment 1 of the present invention.
Figure 5B:
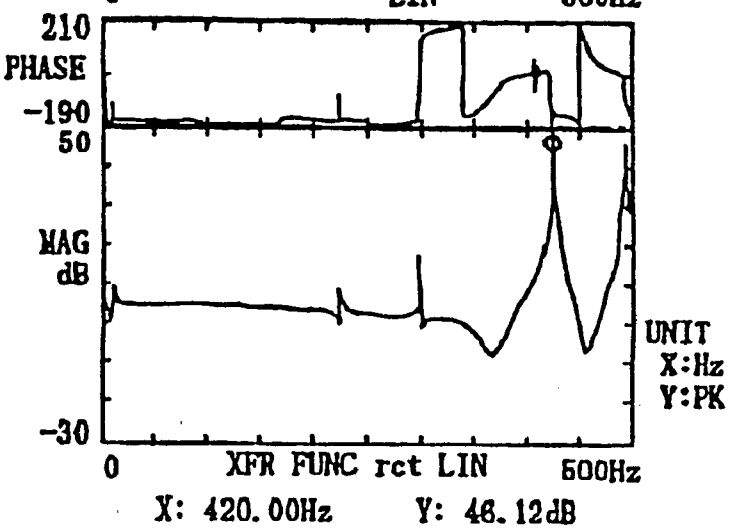
FIG. 5*b* shows a characteristic of a natural frequency of the sirocco fan according to Embodiment 1 of the present invention.

A fan monolithically formed by a magnesium alloy has extremely excellent strength and suitable for a high revolution. FIG. 5*a* illustrates a characteristic of a natural frequency of a steel fan in a conventional technique. FIG. 5*b* illustrates a characteristic of a natural frequency of a monolithically molded fan made of a magnesium alloy according to the present invention. A shape and dimensions of the magnesium fan are as described above. As for the steel fan, the outer diameter of an impeller is 180 mm, the width of the impeller is 110 mm, the number of vanes is 54, a main plate and a side plate are made of a steel respectively having a thickness of 1.2 mm, a material of the vanes is a steel, the thickness of the vanes is 0.4 mm, and the vanes are caulked and coated to increase a strength.

As illustrated in FIGS. 5*a* and 5*b*, the natural frequency of a structure of caulking the steel plates of an impeller is 180 Hz, the natural frequency of the molded object of the magnesium alloy is drastically improved to 420 Hz. Thus, it is possible to reduce a weight by omitting the caulked portions, to reduce a noise because of a smooth surface of the molded object, to bear with a high revolution because of a drastically improved rigidity, and to reduce vibrations and a mechanical noise caused by the vibrations.

Figure 8:
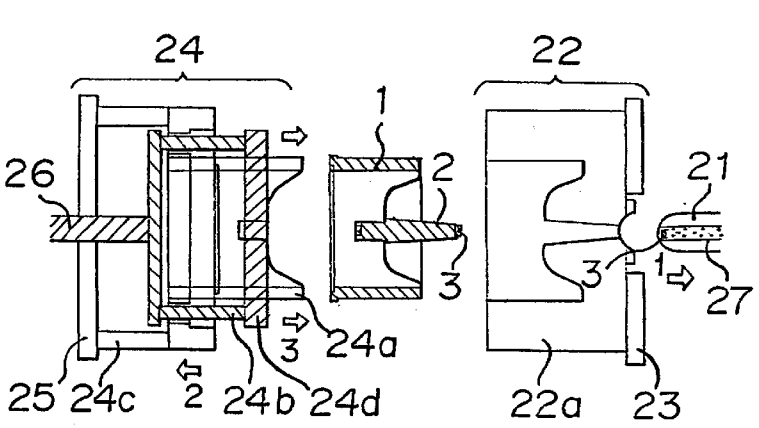
FIG. 8 illustrates the method of producing the sirocco fan according to Embodiment 1 of the present invention.
Figure 6:
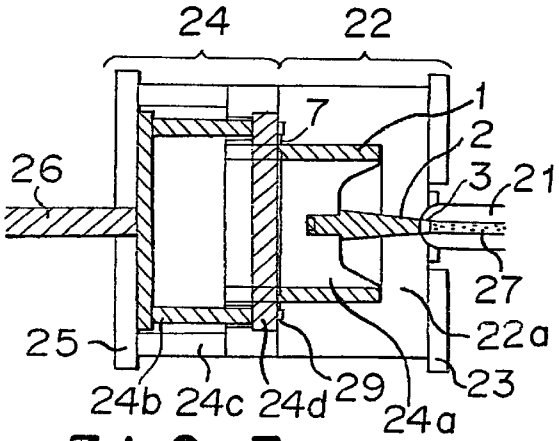
FIG. 6 illustrates a method of producing the sirocco fan according to Embodiment 1 of the present invention.
Figure 7:
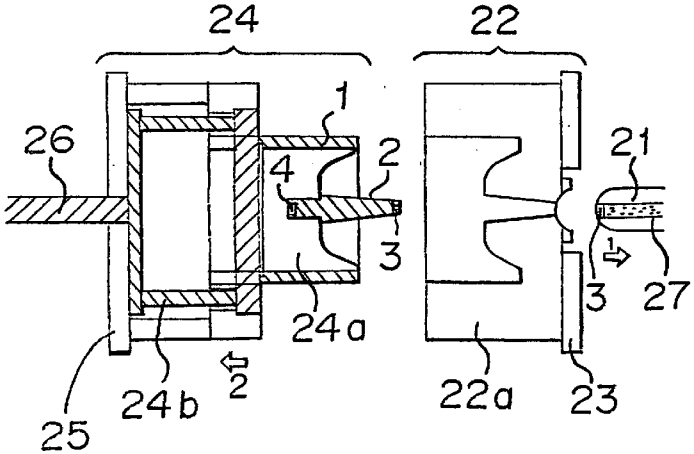
FIG. 7 illustrates the method of producing the sirocco fan according to Embodiment 1 of the present invention.

A method of producing by a direct gate method adopted in the present invention, namely a method of producing illustrated in a cross-sectional view of FIG. 3 before processing the gate, will be described. In FIGS. 6 through 8, a structure of a metal mold and a mold releasing operation will be described. In FIGS. 6 through 8, numerical reference 1 designates a molded portion of a product, which is the impeller; numerical reference 2 designates the first spool as the gate; numerical reference 21 designates a tip nozzle of the injection molding machine, an outlet of which is choked by the coagulate metal 3; numerical reference 22 designates the fixed part of the metal mold having a fixed mold base 22*a* as a metal mold in the outer periphery of the vanes and fixed to a fixed part of the molding machine through a fixed die plate 23; numerical reference 24 designates a movable part of the metallic mold movably constructed by a movable die plate 25 after molding; numerical reference 26 designates an extrusion equipment for taking out the molded object; numerical reference 24*a* designates a mold base; numerical reference 24*b* designates an ejector; numerical reference 24*c* designates a spacer block; numerical reference 24*d* designates a stopper plate; and numerical reference 27 designates the molten magnesium alloy.

The molding machine is constructed such that the cavity 22 of the fixed portion of the metal mold is fixed to the molding machine by the fixed die plate 23, and a shape of one side of the product to be leftward and rightward cut is engraved in the cavity 22. There is a case that the shape of the product is engraved in an insert die having the mold base 22*a*, and the insert die is assembled in the mold base 22*a*. In the core 24 as the movable part of the metal mold, a shape of the other side of the product is engraved in the mold base 24*a* as the cavity 22. The core 24 is composed of the mold base 24*a*, the ejector 24*b* for pushing out the product, and the spacer block 24*c*, wherein the ejector 24*b* leftward-and rightward slides in a range of the spacer block 24*c* in receipt of a force of the extrusion equipment 26. The stopper plate 24*d* is attached to a tip of the ejector 24*b* to release the product from the movable mold base 24*a* in order to take this out.

In the next, a molding process will be described. As illustrated in FIG. 6, the melted magnesium alloy 27 injected from the tip nozzle 21 is charged into the shape of the product, engraved in the insert dies on one or both sides of the fixed mold base 22*a* and the movable mold base 24*a*, within a very short time. For example, in case of the molding machine having a mold blocking force of 450 ton, the melted magnesium alloy is charged within $^{10}/_{100}$ seconds, cooled for about several seconds after oiling a pipe (not shown), in the metal mold without changing conditions, and formed to be the final product 1 in a fixed state in the mold bases. A portion connecting the product 1 to the tip nozzle 21 is called a gate, which is the first spool 2 in FIGS. 6 through 8.

Generally, a gate is named a spool when the gate is arranged in a direction of a shaft, which is an injecting direction, and a runner when the gate is arranged in a direction perpendicular to the injecting direction.

As illustrated in FIG. 7, the tip nozzle 21 of the injection molding machine, movably located in the shaft direction, is separated from the fixed cavity 22. By this movement, a connection between the tip nozzle 21 and the fixed cavity 22 is cut at the coagulate plug 3, positioned on a tip end of the nozzle, whereby the product 1 and the tip nozzle are divided at a substantially center of the coagulate metal.

Then, the movable core 24 is separated from the fixed cavity 22 by the operation of the molding machine. At this time, the product should be in contact with the mold base 24*a* of the movable core 24. Provided that the product is incontact with the fixed cavity, because the cavity 22 does not have a mechanism for taking out the product 1, it is impossible to take out the product from the metal mold. Accordingly, a mold releasing resistance between the mold base 24*a* and the product 1 should be larger than a mold releasing resistance between the thixomolding base 22*a* and the product 1. In other words, it is necessary that a mold releasing resistance on a fixed side is smaller than that on a movable side.

Then, as illustrated in FIG. 8, the stopper plate 24*b* attached to a tip of the ejector 24*b* slides in the fixed side by a force of the extrusion equipment 26 so as to take the product 1 out of a movable mold base 24*a*. The above operation is realized by a movement in the shaft direction based on the fixed part of the metal mold, and automated by a machine, whereby a mass production is realized by a simple device within a short injection time.

Although the injection molding method mainly by the thixomolding method has been described, a die-cast method can be used as a metal molding method, by which the sirocco fan is monolithically molded in use of a magnesium alloy. Because an injection rate is low in the die-cast method in comparison with the thixomolding method, the die-cast method is not suitable for a product having thin vanes and elongated in an axial direction like a sirocco fan. Although it is necessary to make leaves of a metal mold large, a sirocco fan having a narrow width of vanes in an axial direction can be formed by the die-cast method.

There are two methods in a die-cast method, namely a cold chamber method and a hot chamber method. The method will be described in reference of the figures. FIGS. 21*a* through 21*d* explain a molding process by a cold chamber method. FIGS. 22*a* through 22*d* explain a molding process by a hot chamber method. In FIGS. 21*a* through 22*d,* numerical reference 109 designates a metal mold; numerical reference 109*a* designates a fixed mold; numerical reference 109*b* designates a movable mold; numerical reference 109*c* designates a mold cavity; numerical reference 130 designates a molten metal; numerical reference 132 designates a pressurizing chamber, i.e. shot sleeve; numerical reference 133 designates an automatic supply machine; numerical reference 134 designates a piston; numerical reference 135 designates a molded object, i.e. a product formed by the molten metal 130; numerical reference 136 designates a gate; numerical reference 137, 138 designates ejector pins; numerical reference 139 designates a tip nozzle; and numerical reference 140 designates a crucible.

FIGS. 21*a* through 21*d* illustrate the cold chamber method. The method comprises Step 1 of supplying the molten metal 130 into the pressurizing chamber 132 as in FIG. 21*a,* Step 2 of injecting the molten metal 130 into the mold metal 109 as in FIG. 21*b,* Step 3 of opening the movable mold 109*b* of the metal mold 109 as in FIG. 21*c,* and Step 4 of extruding the molded object 135, i.e. the product, formed by the molten metal 130 as in FIG. 21*d.* FIG. 24 relates to the Step 1, in which the molten metal 130 is flown into the pressurizing chamber 132 by the automatic supply machine 133. Numerical reference 145 designates a base for supporting the metal molds 109*a,* 109*b,* the pressurizing chamber 132, and so on.

In the cold chamber method, the pressurizing chamber 132 does not exist in the molten metal 130 being a molten magnesium alloy. Therefore, the pressurizing chamber is not heated. The molten metal 130 is supplied to the pressurizing chamber from a heat reserving furnace (not shown) by each cycle in Step 1. In the next, the molten metal 130 is injected into an inside of the mold cavity 109*c* engraved in the metal mold 109 by leftward sliding the piston 134 in the pressurizing chamber 132 in Step 2. In the next, the metal mold 109 is opened after moving the movable mold 109*b* of the metal mold 109 to a left side of FIGS. 21*a* through 21*d.* Finally, in Step 4, the product 135 is pushed by the ejector pins 137, 138 to take out of the fixed mold 109*b.* Because the gate 136 formed at time of molding is attached to the product 135, it is removed in a later process. In the cold chamber method, although a time for molding is longer than the hot chamber method, it is possible to cast a metal having a high melting point because the pressurizing chamber 132 does not exist in the molten metal 130.

Meanwhile, a hot chamber method will be described in reference of FIGS. 22*a* through 22*d.* The hot chamber method comprises Step 1' of flowing a molten metal 130 into a pressurizing chamber 132 as in FIG. 22*a,* Step 2' of injecting the molten metal 130 into the metal mold 109 as in FIG. 22*b,* Step 3' of opening the movable mold 109*b* of the metal mold 109 as in FIG. 22*c,* and Step 4' of extruding a molded object 135, i.e. the product, which is molded by the molten metal 130, out of the metal mold 109 as in FIG. 22*d.*

Figure 25:
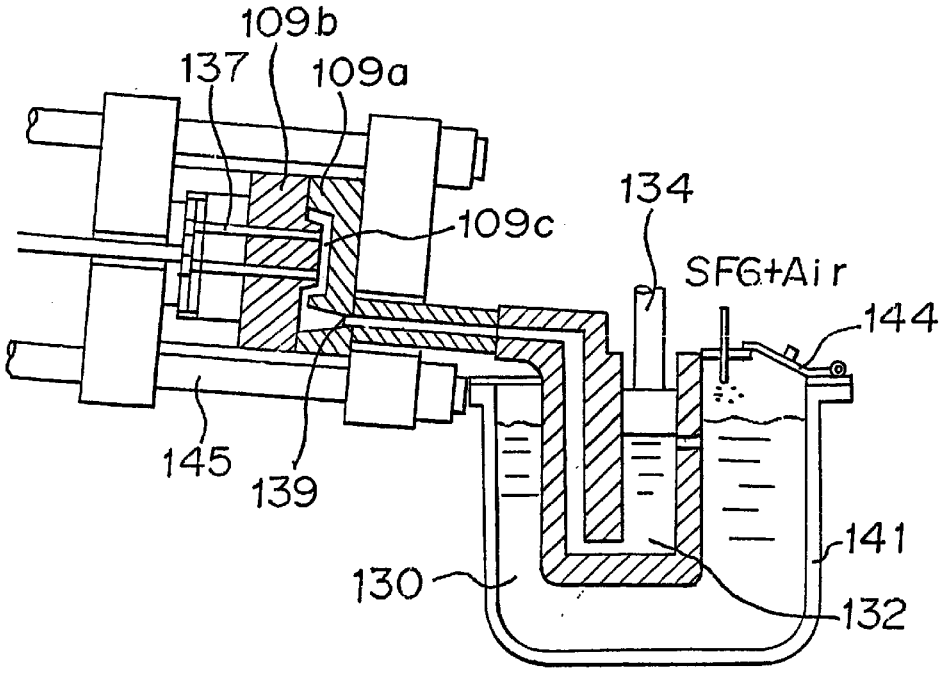
FIG. 25 illustrates a hot chamber method.

The pressurizing chamber 132 is positioned in the molten metal 130 and heated. The method of molding is just like a water gun. At first, the molten metal 130 is heated at a high temperature of about 630° C. in a crucible. In the pressurizing chamber 132, the molten metal is supplied from an inlet 141 of the pressurizing chamber in a state that the piston 134 is risen in Step 1'. In Step 2', the piston 134 downward slides inside the pressurizing chamber 132, whereby the molten metal 130 is injected inside the mold cavity 109*c* engraved in the metal mold 109 from a tip nozzle 139. If a joint surface between the tip nozzle 139 and the metal mold 109 is not tight, a melting magnesium alloy may blow into an air and burn. Therefore, it is necessary to carefully adjust the joint surface. FIG. 25 relates to Step 1', in which the crucible 140 is tightly closed by a lid 144 and so on. A magnesium alloy ingot as a material of the molten metal 130 is added after opening the lid 144 attached to the crucible 140. In order to avoid the molten magnesium alloy reacts with an air at this time, an area between the lid 144 and the molten metal 130 is always filled with SF6+Air, whereby the area is tightly closed for maintaining a quality of the molten metal 130. Numerical reference 145 designates a stage for supporting the metallic molds 109*a,* 109*b,* the pressurizing chamber 132, and so on.

In Step 3', the movable metal mold 109*b* is moved on a left side in FIG. 22*c,* the metal mold 109 is opened, and the piston 134 is lifted. Finally, the product 135 is pushed out of the movable metal mold 109*b* in use of the ejector pins 137, 138 in Step 4'. Because the gate 136, molded at time of molding the product 135, is attached to the product 135, the gate is removed in a later step. In this state, the pressurizing chamber 132 and the piston 134 can inject the metal for the following steps.

As described, because it is not necessary to supply the metal into the pressurizing chamber 132 by each cycle, a time for molding can be shortened. However, because the pressurizing chamber 132 exists in the molten metal 130, a material having low reactivity with molten magnesium and an excellent heat resistance property is used as materials of the pressurizing chamber 132 and the piston 134. A heat resistance steel having a high fusion point can be used because magnesium has low reactivity with iron. However, because the molten metal is injected at a high temperature of about 630° C., the piston 134 vertically moves in the pressurizing chamber 132 at a high speed. Therefore, it is necessary to overhaul the pressurizing chamber 132 and the piston 134 by, for example, every 100,000 shots, wherein a cost of molding becomes high. A large difference from an aluminum die-cast is that a hot chamber method-can be used because magnesium has low reactivity with iron to enable continuous molding in a similar manner to thixomolding, wherein it is necessary to consider safety. Because reactivity between aluminum and iron is high, a hot chamber method is not practically used.

Characteristics of the hot chamber method and the cold-chamber method are that in a cold chamber machine, a large component is produced, and in a hot chamber machine, a small component is produced. However, the hot chamber machine is better in point of prevention of oxidization of the molten metal, a casting pressure, productivity, and so on. When producing a great amount of small components, a hot chamber machine should be used in order for enabling continuous molding within a short molding time, or same metal molds are additionally necessary because a single metal mold is not sufficient to produce a large number of products.

Because in a die-cast method, a mold blocking force of a molding machine can be made about a half of that in a thixomolding method, it is possible to mold using a small-sized molding machine. Although, it is necessary to provide a receiver 4 for accommodating a coagulate plug 3, which receiver is necessary in case of thixomolding, a gate has a similar shape to that in thixomolding.

In a cold chamber method, when steps of operation are right and an accuracy of a metal mold is assured, abnormality does not suddenly occur. However, in a hot chamber method, abnormality occurs at an unpredictable time. A burr of a semi-fusion magnesium alloy 111 is frequently occur by blow and burn of the semi-fusion magnesium alloy 111, caused by an insufficient contact between the tip nozzle 139 and the metal mold 109 as in thixomolding. In the hot chamber method, it is necessary to completely remove moisture in an ingot of a material enclosed in a pallet by drying the ingot in a volatility oven. However, when a moisture condensation is left in a center of the ingot by insufficient drying, a molten metal is spread at time of throwing the ingot to a crucible. Moisture and magnesium left in the cavity by twice blowing a mold releasing agent are reacted in the cavity to abnormally burn. There are reported cases that moisture is condensed in a shot sleeve because the shot sleeve is not sufficiently heated, and moisture and magnesium are reacted to cause an abnormality. Now molding is automated to deal therewith.

Embodiment 2

Figure 9:
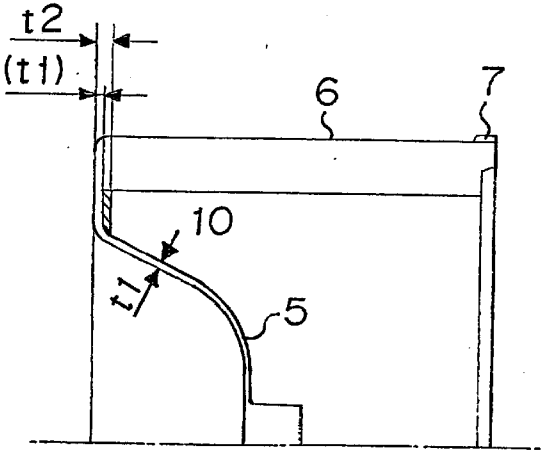
FIG. 9 illustrates a structure of a part of the sirocco fan according to Embodiment 2 of the present invention.

There are many technical problems in injection molding of an magnesium alloy, which is different from molding of plastic at various points. A material of an magnesium alloy is much stronger than a plastic, and contraction is much smaller than a plastic. Therefore, it is necessary to devise a new structure for pushing out and pulling out a product out of a metal mold and a new structure for releasing a metal mold. Further, various problems are solved for evenly supply and charge a molten metal into various portions of a thin plates product having a complicated structure like a sirocco fan, which is formed by arranging a large number of thin plates having a thickness of about 1 through 2 mm, which is difficult to be produced by a die-cast in use of ultra-high rate charge charging of a molten metal. FIG. 9 illustrates a connecting portion between a main plate and vanes. A bending portion 10 is located for facilitating an instantaneous flow of a molten metal from the main plate to the vanes further flows into a large number of parallel circuits. The bending portion 10 is illustrated by hatching in FIG. 9. In the bending portion 10, the thickness t2 of an entire outer peripheral portion, being a linear portion attached to a central recess of the main plate, is 1.5 times or more of the thickness t1 of the recess.

Figure 11A:
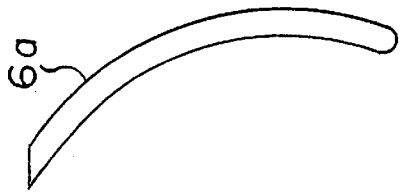
FIG. 11*a* illustrates a structure of a part of the sirocco fan according to Embodiment 2 of the present invention.
Figure 11B:
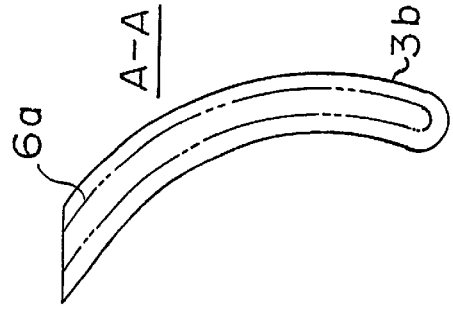
FIG. 11*b* illustrates a structure of a part of the sirocco fan according to Embodiment 2 of the present invention.
Figure 10:
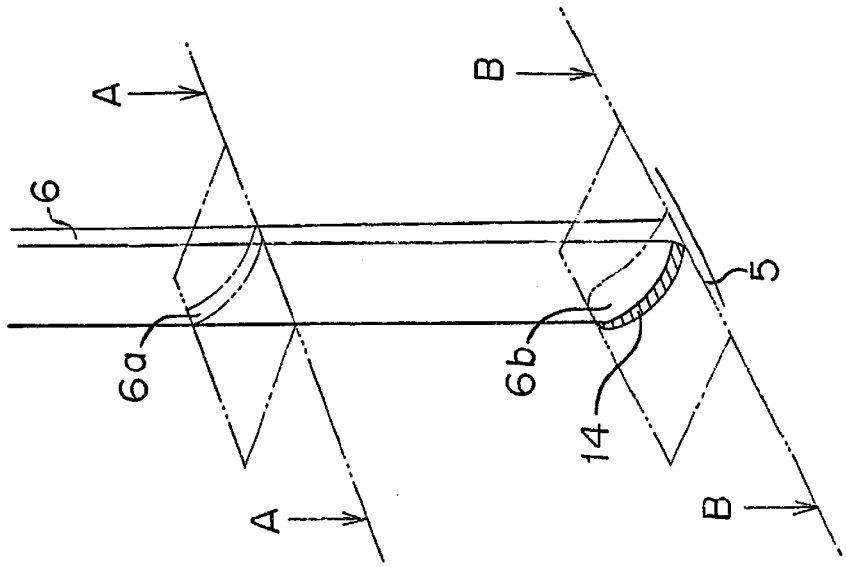
FIG. 10 illustrates a part of a structure of the sirocco fan according to Embodiment 2 of the present invention.

FIGS. 10, 11*a*, and 11*b* illustrate a shape of the vanes. Numerical reference 14 designates a joining portion between the main plate 5 and the vanes 6; which joining portion is chamfered. A cross-sectional shape of a portion 6*a* along a line A—A in a middle of a longitudinal direction of the vanes is illustrated in FIG. 11*a*. A cross-sectional shape of a portion 6*b* along a line B—B at a joining surface between the vanes and the main plate is illustrated in FIG. 11*b*. The joining surface is much larger than other portions of the vanes. A fan is made as a sample so that the chamfered portion is 1.5 mm, which is larger than the thickness 1.2 mm of a tip of the vanes, and the thickness of the portion 6*b* is 5.52 mm by forming the chamfered portion in a root of the vanes having a thickness of 2.52 mm. Such a structure is effective for an instantaneous charge. In case of conventional plastic molding, when the thickness of a root of vanes becomes abruptly larger than the thickness of a main plate 5, a sinkmark is formed on a back surface of a joining portion between the main plate and the vanes so as to be in an uneven shape. Therefore, a large chamfered portion and a round are not formed in the root of the vanes. However, such a structure is necessary to securely charge by evenly flow a magnesium alloy instantaneously to various parallel circuits.

It is important to obtain a condition, by which a magnesium alloy is successfully molded by drying various amounts of a metal charged in an injection molding machine. From a state of a short shot, in which a metal mold is not completely charged, the amount of the metal is gradually increased to a state of a full pack, in which a product is completely charged without charging an overflow circuit. If the metal is injected as much as an inner volume of the metal mold or more, a burr is produced from a gap between an overlapped surface of the metal mold more than necessary, whereby a fixed side of the metal mold cannot be released from a movable side of the metal mold. In case of thixomolding, it is necessary to charge under a state of low viscosity within an extremely short time. Therefore, a phenomenon that the molten metal is certainly picked occurs. In this phenomenon, the molten metal is not sequentially filled from a firstly charged portion around a gate of a metal mold, but the molten metal is, injected and attached to a tip portion of the metal mold to be finally charged in a state of a short shot, whereby the metal exists in the tip portion of the metal mold. In such a case, molding may not be further proceeded because the metal charged in the tip portion of the metal mold cannot be taken out. Further, there is a danger that a semi-fusion magnesium alloy blows into an air from a gap between the metal mold and the tip nozzle of the molding machine even though the molding machine is closed, wherein it is necessary to prepare a fire extinguishant in the molding machine. It is possible to easily determine a proper charging amount by locating an overflow circuit in this case. Accordingly, an injection amount and an amount of supplying a metal are not completely in conformity with in thixomolding.

Although, in the molding process illustrating in FIG. 7, it has been described that the product 1 should be in contact with a side of the mold base 24*a* of the core 24, because it is difficult in molding a metal that an undercut portion, i.e. a shape by which the product 1 cannot be released from the core 24 because of dimensions of the products and the cores, is partly located in molding a magnesium alloy, a burr is inevitably produced in keeping a certain gap therebetween. However, leaves of an outer diameter of an impeller are increased in comparison with leaves of the vanes in order to minimize the gap to an extent that the fan can be molded and released from the metal mold. In case that a product does not have a complicated shape with thin plate-like vanes, leaves of any portion of a fan is about $^{20}/_{1000}$, i.e. 1.5°, in molding a magnesium alloy. In the present invention, by making leaves very small such that the leaves of the vanes are $^{6}/_{1000}$, and the leaves of the outer periphery of the impeller are $^{10}/_{1000}$, i.e. about 0.5° by providing a special treatment on the surface of the metal mold, it is possible to enable an easy production by reducing a dimensional difference between the outer diameter of the impeller on a side of the stiffening ring of 180 mm and the outer diameter of the impeller on a side of the main plate of 177.8 mm, and to assure a necessary property of the fan.

Figure 12:
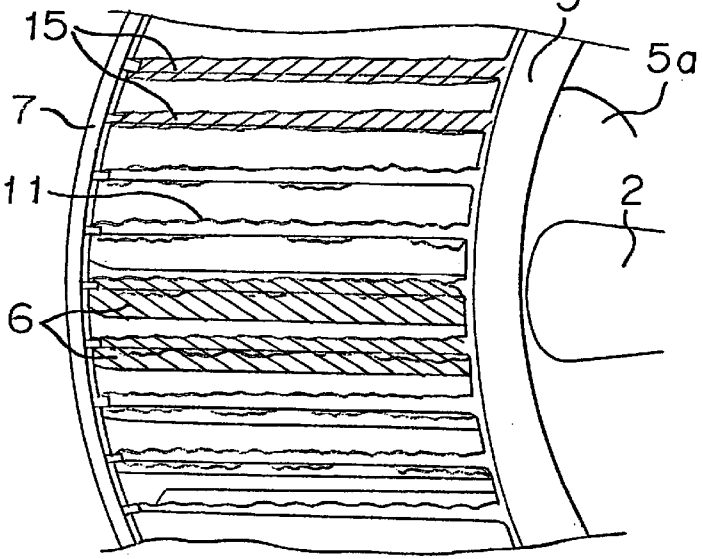
FIG. 12 illustrates a structure of a part of the sirocco fan according to Embodiment 2 of the present invention.

FIG. 12 partly illustrates the impeller viewed from an outer peripheral side thereof. When the metal mold is released after molding, a structure is as follows. Numerical reference 6 designates vanes; numerical reference 11 designates a burr left in a gap of the metal mold; and numerical reference 15 designates a contact surface of metals between an outer peripheral metal mold, i.e. the cavity 22, and an inner peripheral metal mold, i.e. the core 24, in which the burr 11 is included. Although the magnesium alloy is hardened in a shape of the vanes as a molded object, the inner peripheral mold extends between the vanes to the outer peripheral portion and is in contact with the outer peripheral metal mold with small gaps therefrom. The burr is flown into the gaps, and therefore the thin burrs, which can be easily removed, are attached to surfaces of the vanes. The burrs can ordinarily be destroyed in use of a shot blast treatment, by which very small particles are blown toward a product at a high speed.

However, as illustrated in FIGS. 11*a* and 11*b*, an end edge of the vanes on a pressure surface has a sharp edge. Therefore, a molten metal injected into a metal mold is not completely charged in the edge positioned at the tip of the metal mold because the molten metal, injected in the metal mold, is rapidly coagulated. Therefore, it is very difficult to completely remove an underfill of the edge, which is observed in case of molding a resin including a fiber glass.

Figure 13A:
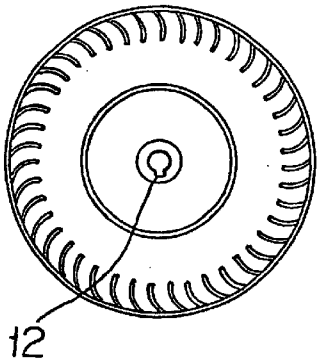
FIG. 13*a* illustrates a structure of a part of the sirocco fan according to Embodiment 2 of the present invention.
Figure 13B:
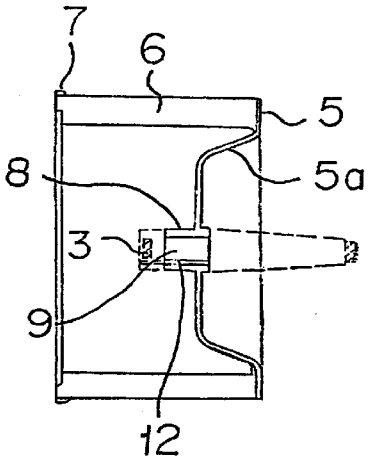
FIG. 13*b* illustrates the structure of the part of the sirocco fan according to Embodiment 2 of the present invention.
Figure 13C:
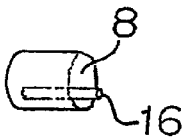
FIG. 13*c* illustrates the structure of the part of the sirocco fan according to Embodiment 2 of the present invention.

FIGS. 13*a* through 13*c* illustrate a structure of a key groove. FIG. 13*a* is a front view of a molded object. FIG. 13*b* is a cross-sectional view of the molded object. FIG. 13*c* explains a part of a metal mold in a boss 8 before charging the molten metal. Numerical reference 9 designates a rotation shaft hole formed in the boss 8 of the molded object. Numerical reference 12 designates a key groove, connected to the rotation shaft hole 9, for transmitting a rotation of a motor. Numerical reference 16 designates a metal mold of a key shaped like a rectangular pin, which is a part of the metal mold corresponding to the key groove located at a place of the metal mold of the boss before molding. When the metal is charged into the space 8 in FIG. 13*c*, a shaft, namely the gate, is molded by escaping from the mold of the key 16, i.e. the pin. The pin is mounted in the metal mold in an inner peripheral side, and pulled therefrom when releasing the metal mold along with the metal mold, whereby a hole in a shape of the key is left in the shaft. After molding the rotation shaft hole 9, the hole of the pin is exposed to form the key groove. Thus, it is possible to reduce mechanical processing of the magnesium metal by monolithically molding the key groove. In case that the actuating motor is an induction type, an impeller of a blower, for example, having an output of about 200 W is connected to a motor shaft by the key groove. In case that a mold blocking force is 450 ton in a thixomolding machine, a coagulate plug 3 has a diameter of 14 mm, and a first spool 2 as a gate is tapered by about 5° and has a length of 90 mm, a root of a tip of the gate has a diameter of about 32 mm. Because an outer diameter of a plug catcher 4 is about 18 mm larger than an outer diameter of a coagulate plug for stopping an movement of the coagulate plug to be accommodated and securely received, a diameter of the rotation shaft hole is 17 mm, and a rectangular hole corresponding to the key groove of the shaft hole of the impeller is constructed by the rectangular key of the metal mold so as to be arranged in an outside of a diameter of the rotation shaft hole for avoiding a collision with the coagulate plug.

Figure 14:
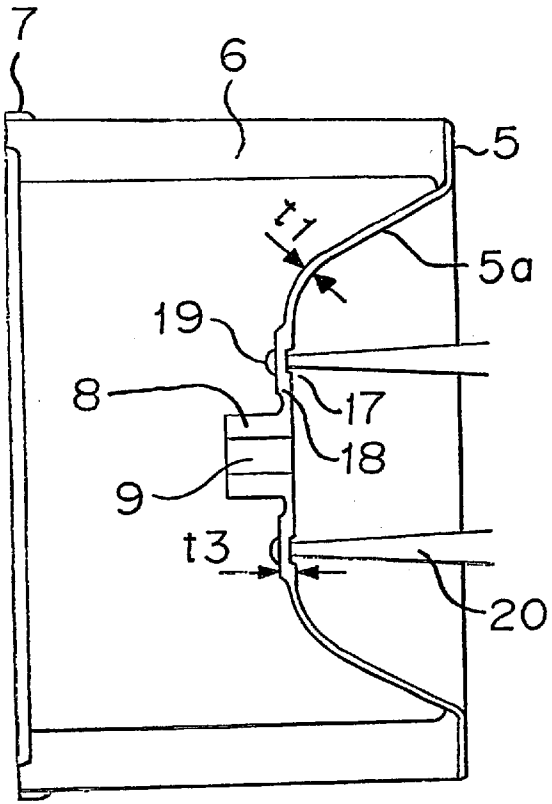
FIG. 14 illustrates a structure of a part of the sirocco fan according to Embodiment 2 of the present invention.

FIG. 14 illustrates a gate of a sirocco fan in case of using a pin gate. Although a case that the gate for injecting a molten metal from a nozzle is a single position has been described above, it is possible to charge a metal injected from the single nozzle from a plurality of inlet holes into a molded object after branching the metal into plural numbers in the gate. In this case, a first spool for flowing the molten metal by conically spreading the molten metal in an injecting direction, as the gate between the nozzle of an injection molding machine and the molded object in the metal mold, and a plurality of second spools branching out of the first spool are located. A tip of the second spool becomes a thin gate connected to the molded object. In FIG. 14, numerical reference 20 designates a pin gate connected to the molded object; numerical reference 17 designates a recessed portion of a portion connected to the pin gate 20, which recessed portion is formed in a main plate; numerical reference 18 designates a thick portion of the main plate, of which area is much wider than a diameter of the recessed portion; and numerical reference 19 designates an accumulator, located in the main plate on a surface opposite to the recessed portion, for relaxing an impact of a metal flowing from the gate. In this structure, the recessed portion is formed so that a cut portion at a tip of the pin gate does not protrude over a flat surface of the main plate 5. The thick portion 18 is formed so that a molten metal smoothly flows into the main plate. Accordingly, an instantaneous injection of magnesium is evenly charged into the plurality of vanes 6.

Although a case that the shaft of the sirocco fan, which shaft is located in the center, is utilized to flow the molten metal into the molded object from the single gate has been described, in order to instantaneously and uniformly charge the molten metal into a large number of vanes arranged in a cylindrical shape without excessively and shortly supplying the metal, it is better to charge from a position in the vicinity of the outer peripheral portion of the main plate for achieving the uniform charge. As a method, the plurality of pin gates are arranged at positions of the outer peripheral portion of the main plate with even pitches. This structure is illustrated in FIG. 14. By locating the metal mold having a shaft structure, it is possible to monolithically mold the fan. Further, by adopting the pin gate, it is possible to easily separate the gate and the molded object at time of releasing the molded object from the metal mold. Thus, the sirocco fan is finished by only releasing from the metal mold when the rotation shaft hole is monolithically molded without mechanically processing the shaft structure. However, in a pin gate method, it is necessary to uniformly flow the molten metal into the large number of pin gates, it is important to enhance an accuracy for dealing with, for example, a deviation of center axes of the tip nozzle and the gate of the metal at the contact portion after molding.

A registration of the contact portion between the tip nozzle and the gate of the metal, namely that of the inlet of the metal mold for the molten metal and the center axis, becomes a difficult operation both in the gate around center of the shaft and in the pin gate method using the plurality of the pin gates arranged around a circumference of the center of the shaft, because a small deviation occurs depending on structures of a long injection molding machine, of a melting temperature of a metal of 600° C. The registration can be adjusted by minutely moving a position of an axis center of a molding machine from a fixed side of the molding machine. In case of a thixomolding method, a structure formed by monolithically molding vanes having a complicated shape formed by a large number of thin plates and a thick part like a shaft has not been practically used because, in a thixomolding, not like a resin molding, an injection is done at a high speed, a viscosity of a molten metal is small for determining an injection amount, and problems that an excessibly charged metal does not fully received by the metal mold or an insufficient metal does not fully charge the metal mold. However, in the present invention, by applying a method completely different from those in a resin molding and a die-cast to the structure, in which a gate arrangement and a flow of the molten metal are changed, a mold structure, a distribution of dimensions of the vanes and the leaves are changed. Thus, the fan can be monolithically molded in use of a type of a metal having small energy, whereby it becomes possible to produce a metallic product with safety, which metallic product can be easily reproduced in also recycling in consideration of the global atmosphere. Further, such a fan has a higher rigidity than that of a fan formed by resin molding, whereby it is possible to produce a sirocco fan, on which noise is small and on which efficiency is good, by an easy method of producing in use of a device for producing, by which a product with a stable quality is produced.

Embodiment 3

Figure 15:
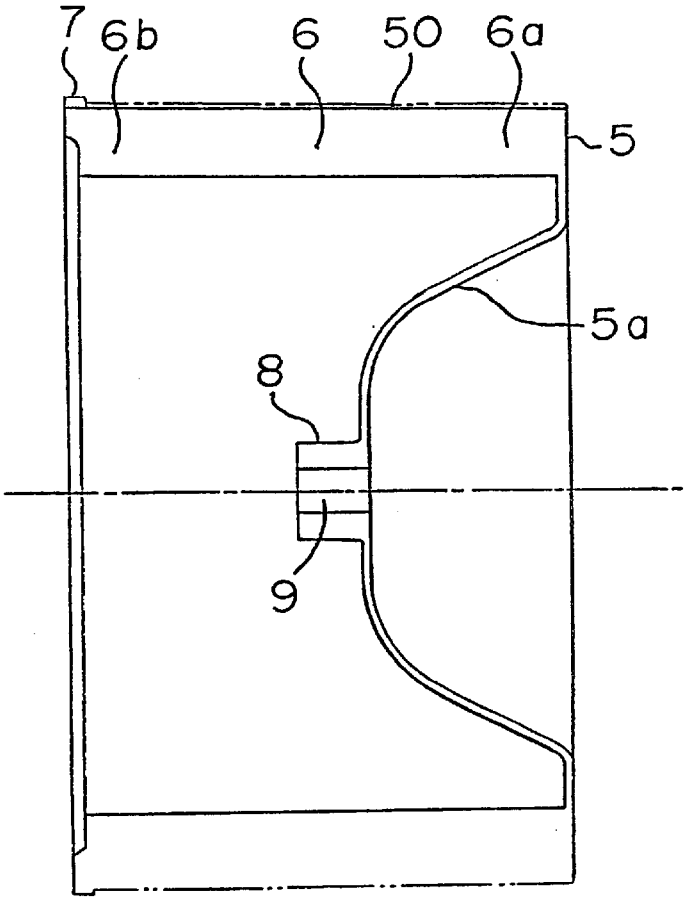
FIG. 15 is a side cross-sectional view of a sirocco fan according to Embodiment 3 of the present invention.

FIG. 15 explains a method of producing an impeller of a sirocco fan according to Embodiment 3 of the present invention. The same numerical reference as those in FIG. 1 designates the same portions, and descriptions of these portions are meted. Numerical reference 50 designates a mold ring thinner than a stiffening ring 7, which is located on an entire surface of an outer periphery of the impeller at time of molding, and removed by mechanical processing after molding. The thickness of the mold ring is about 1 mm in consideration of moldability. At time of molding, there are a step of injecting a molten metal into a molded object, and a step of charging the injected metal into vanes 6, the stiffening ring 7, and the mold ring 50.

Although, in FIG. 1, the bending portion 10 is formed in the metal mold for facilitating the flow of the molten metal by increasing the side of the inner diameter of the vanes at the portion, where the vanes 6 are connected to the main plate 5, a bending portion is not used in Embodiment 3. In FIG. 1, the molten metal flows from the gate 2 through the main plate 5 to the outer peripheral portion of the main plate 5, thereafter those to the tip portion of the vanes 6*b* on the side of the stiffening ring 7 through the bending portion 10, formed in the root 6*a* of the vanes 6, from the root 6*a*, further flows into the stiffening ring 7, and flows into the overflow circuit 29, provided in the tip of the stiffening ring 7 in FIG. 3. In other words, it is necessary to uniformly and rapidly charge the molten metal from the root of the large number of thin vanes 6 to the tip. On the contrary, in Embodiment 3 the molten metal is not only charged from a root of the thin vanes 6 to a tip but flows from the mold ring 50 located in the outer peripheral portion of the vanes 6 through a side of an outer diameter of the vanes, i.e. an end edge 6*d* of the vanes illustrated in FIG. 19, to a side of an inner diameter of the vanes, i.e. a front edge side 6*c* of the vanes illustrated in FIG. 19. Further, the end edge side 6*d* of each vane is joined by the mold ring 50, whereby the molten metal is uniformly charged into each of the vanes. Although the stiffening ring 7 is in an upper portion or a lower portion of the vanes 6, each may be located in an end portion on a left side of FIG. 15.

The mold ring 50 prevents a state that a fixed part of the metal mold and a movable part of the metal mold are not released by an unnecessary burr produced from a gap of an overlapped surface of the metal mold at time of injecting the molten metal as much as more than a capacity of the metal mold. In FIG. 12, numerical reference 15 is shaped by a metallic contact surface between the outer peripheral mold, i.e. a cavity 22, and an inner peripheral metal mold, i.e. a core 24, including the burr 11. By locating the mold ring 50, the metallic contact surface 15 does not exist, and the burr 11 is not formed.

In case of thixomolding, it is necessary to charge the molten metal with a low viscosity within an extremely short period. Therefore, the molten metal is hardly skipped. In such a case, a metal charged in a tip of the metal mold cannot be taken out, and succeeding molding is stopped. Such a situation is avoided in Embodiment 3. The situation is apt to occur in case that a dimension in a direction of a cast from a root to a tip end of the vanes is long and the vanes are thin. However, when there is a flow of the molten metal from the mold ring 50, located in the outer peripheral portion of the vanes 6, exists, this situation hardly occurs. Further, the distance between the back edge 6*d* and the front edge 6*c* of the vanes is extremely shorter than a distance between the root 6*a* and the tip 6*b* of the vanes. Therefore, the partly skipped portion of the molten metal is connected to the mold ring 50, whereby it is possible to take out of the metal mold. Although the thickness of the mold ring 50 may be adjusted by trying molding, the thickness is ordinarily 1 mm or more in consideration of the above-mentioned condition, wherein it is sufficient to increase the thickness after trying the molding so that the metal mold is cut.

In other words, by providing the mold ring 50, an ejector pin becomes unnecessary for pushing the vanes to forcibly remove the partially skipped portion. Instead, an ejector pin for forcibly pushing the mold ring is located so that the vanes are pushed along with the mold ring 50, joined to the vanes in the outer peripheral portion of the vanes, whereby a structure of the metal mold becomes easy, a cost for making the metal mold becomes low, and durability becomes sufficient. Although it is necessary to remove the mold ring in a later process, a cost resultantly becomes low in producing a fan because problems such as an underfill at the tip of vanes are solved, an yield is improved, a cost of the metal mold and a cost for maintaining the mold are drastically reduced.

Embodiment 4

Figure 16:
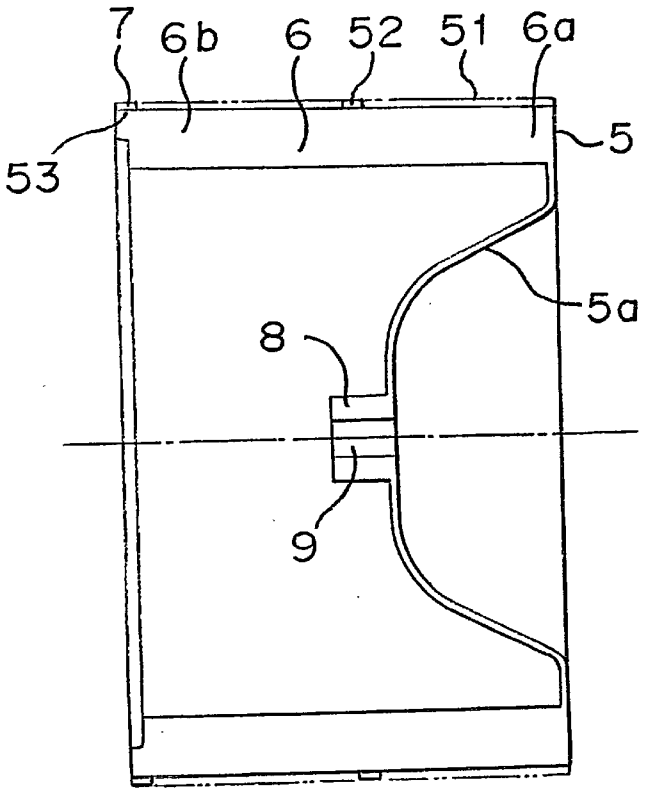
FIG. 16 is a side cross-sectional view of a sirocco fan according to Embodiment 4 of the present invention.

Embodiment 4 of the present invention will be described in reference of FIG. 16. The same numerical references as those in FIG. 15 designates the similar portions, and description of these portions is omitted. Numerical reference 51 designates a mold ring having the same thickness as the stiffening ring 7, which is located on an entire surface of vanes at time of molding, and removed by mechanical processing after molding. The thickness of the mold ring 51 is thicker than that in FIG. 15 because it has the same thickness as the stiffening ring 7, of which the thickness is about 2 mm in consideration of a strength. In this case, steps of mechanical processing the mold ring are increased than in FIG. 15, whereby a cost of processing is increased. However, a width of the stiffening ring can be freely designed, for example, when the strength is necessary, it is possible to increase the width of the stiffening ring even though the entire width of the vanes is increased. Numerical reference 52 designates an auxiliary ring positioned in a center between the stiffening ring 7 and main plate 5 so as to cover an outer peripheral surface of the vanes 6 like the stiffening ring 7. It is very easy to form the auxiliary ring because it can be formed without mechanically processing the mold ring 51 at a corresponding portion. By locating the auxiliary ring 52, the vanes 6 are supported not only by the stiffening ring 7. In such a sirocco fan, a tip 6*b* of the vanes 6 and a joining portion 53 between the vanes and the stiffening ring 7 receive a largest stress and are easily broken. A stress applied to the stiffening ring 7 is reduced by the auxiliary ring 52.

Embodiment 5

Figure 17:
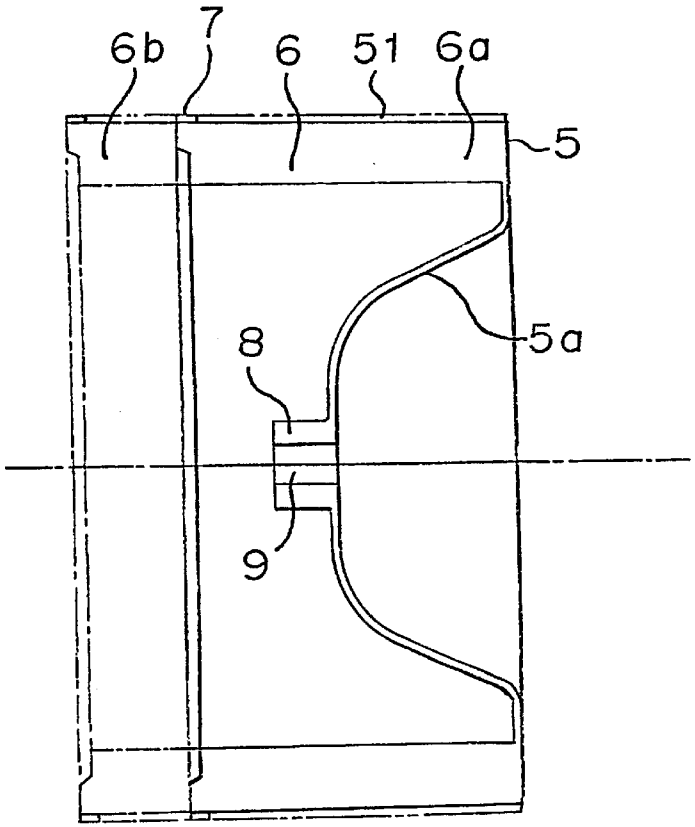
FIG. 17 is a side cross-sectional view of a sirocco fan according to Embodiment 5 of the present invention.

Embodiment 5 of the present invention will be described in reference of FIG. 17. The same numerical references as those in FIG. 16 designates the similar portions, and description of these portions is omitted. On a side of a tip 6*b* of the vanes, the length of the vanes in the direction of the shaft is shortened in comparison with FIG. 16. In Embodiment 5, the vanes 6 are cut on the side of the tip end 6*b* of the vanes so that the distance between the tip end 6*b* and a root 6*a* of the vanes is shortened. Thereafter, a mold ring 51 on an outer peripheral portion of the vanes is cut without removing a stiffening ring 7 as in FIG. 16. In this case, it is possible to change the width of the vanes, namely, the length of the vanes 6. Therefore, in case of producing vanes having different widths, it is not necessary to produce a metal mold for an exclusive use. It is sufficient to produce a metal mold for longer vanes, whereby it is possible to reduce a cost of the metal mold, and a production cost is resultantly reduced.

Embodiment 6

Figure 18:
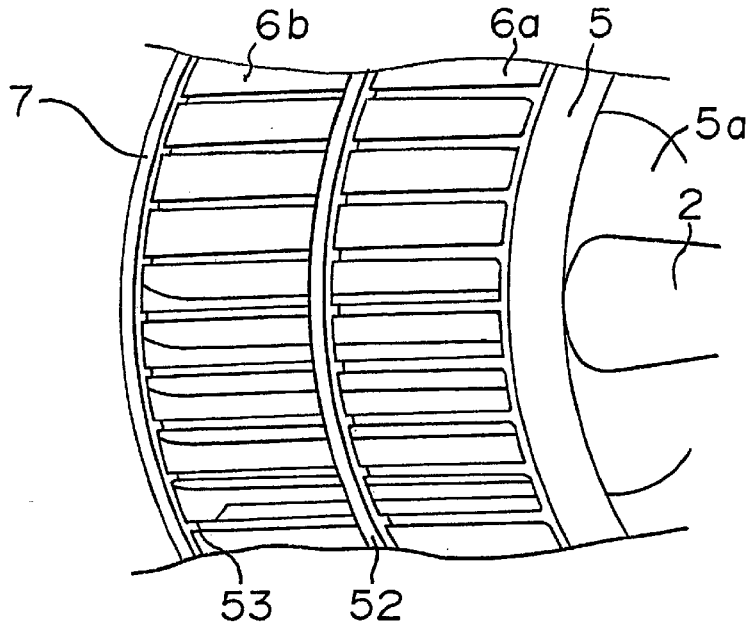
FIG. 18 is an enlarged perspective view of a sirocco fan according to Embodiment 6 of the present invention.
Figure 19:
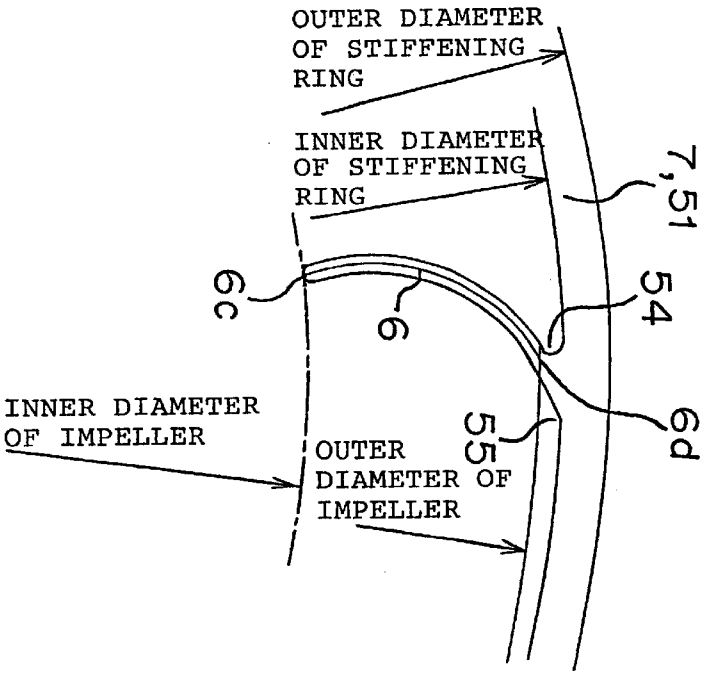
FIG. 19 is an enlarged front view of the sirocco fan according to Embodiment 6 of the present invention.
Figure 21A:
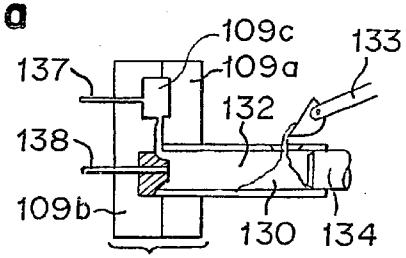
FIG. 21*a* illustrates a process of molding by a cold chamber method.
Figure 21B:
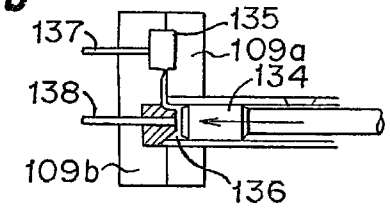
FIG. 21*b* illustrates the molding process by the cold chamber method.
Figure 21C:
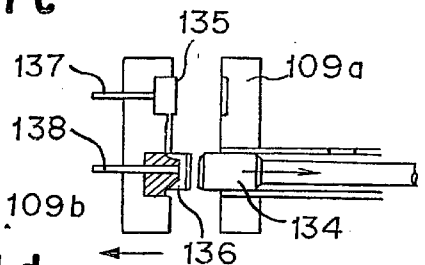
FIG. 21*c* illustrates the molding process by the cold chamber method.
Figure 21D:
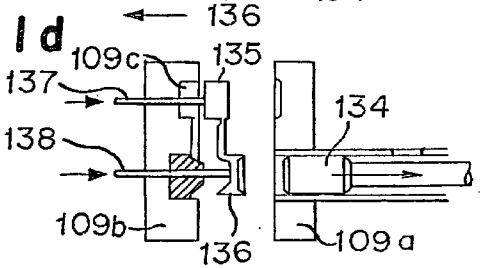
FIG. 21*d* illustrates the molding process by the cold chamber method.

FIG. 18 is an enlarged perspective view of a joining portion of a stiffening ring 7 and vanes 6. Numerical reference 19 designates a front view. In FIGS. 18 and 19, an inner diameter of the stiffening ring 7 is a little larger than an outer diameter of the vanes. The vanes 6 have rounded portions 54, 55 so that an end edge 6*d*, as an outer peripheral portion, is joined to an inner peripheral portion of the stiffening ring 7. The rounded portions 54, 55 are positioned in the outer peripheral portion of the outer diameter of the vanes. In case that an outer peripheral portion of a mold ring 51 is mechanically processed to have an outer diameter same as the outer diameter of the vanes, the end edge 6*d* of the vanes 6 is exposed from the mold ring 51, and the rounded portions 54, 55 are removed. Therefore, it is possible to preferably send an air without influencing a blow air by the rounded portions 54, 55 left in the peripheral portion of the vanes. Further, a joint between the end edge 6*d* positioned in the outer peripheral portion of the vanes, i.e. the outer diameter of the vanes, and the stiffening ring 7 becomes firm, and a property of molding the mold ring is improved.

In the next, a method of mechanically processing the mold ring will be described.

Figure 20:
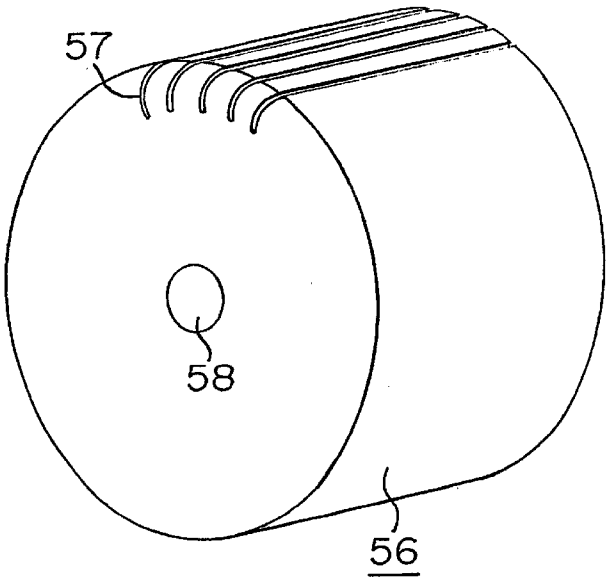
FIG. 20 is a perspective view of a jig for producing the sirocco fan according to Embodiment 6 of the present invention.
Figure 24:
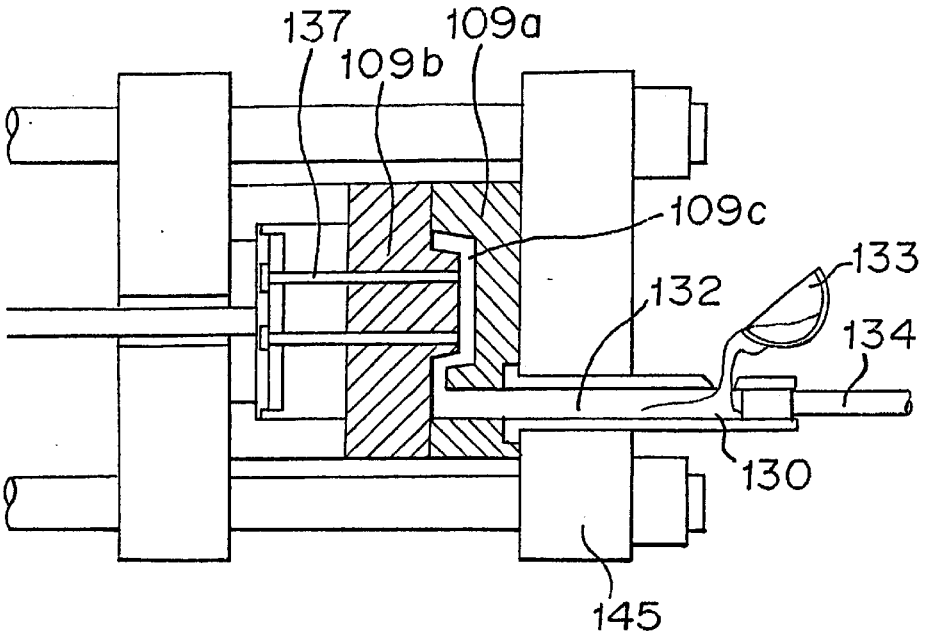
FIG. 24 illustrates a cold chamber method.

In FIG. 20, numerical reference 56 designates a jig inserted from a side of the stiffening ring 7 into an inner surface of the vanes 6. Under a state that the vanes are housed in vane grooves 57 of the jig 56, the vanes are not reformed by a force applied at time of mechanically processing, whereby it is possible to mechanically process with a high accuracy and a high rate. It is possible to preferably process when an outer diameter of the jig 56 is a little smaller than the outer diameter of the vanes, for example, by 0.5 mm. Further, because the shaft hole 58 is formed in a center of the jig 56, an axial center is easily determined at time of processing.

Embodiment 7

FIG. 23 is a cross-sectional view of a sirocco fan in a state of processing a gate according to Embodiment 7 of the present invention. The same numerical references as those in FIGS. 1 and 6 respectively designate the same portions. In FIG. 23, numerical reference 2 designates a gate; numerical reference 5 designates a main plate, numerical reference 5*a* designates a choked portion; numerical reference 6 designates vanes; numerical reference 7 designates a stiffening ring; numerical reference 8 designates a boss; numerical reference 9 designates a rotation shaft hole; numerical reference 22*a* designates a mold base, on a right side of which a shape of one side of a product to be molded is engraved; numerical reference 33 designates an impeller; and numerical reference 143 designates a pin for a metal mold for a rotation shaft.

When it is difficult to increase the outer diameter of the boss 8, the rotation shaft hole formed by the rotation shaft metal mold pin 143 is increased in a later process. In such a case, because the shaft hole is already opened without starting to process the shaft hole, processing becomes easy. Further a power of an actuating motor is increased as described, whereby it is possible to deal with a case that a diameter of the shaft of the actuating motor is increased.

The rotation shaft metal mold pin 143 may be formed by locating a pin having a type similar to a rotation shaft hole 7 on a side of a movable part of the metal mold opposite to an injection side of the gate 2.

As described, a method of producing a fan according to this Embodiment comprises: a step of providing the rotation shaft metal mold pin 143 in the same shape as the rotation shaft hole 9 and injecting the molten metal from the shaft, which is located in a center of the hub for supporting the impeller, rotated by the motor, and monolithically molded by simultaneously melting the impeller and the metal, and a step of removing a part of the gate to form the rotation shaft hole 9 after forming a molded object by injecting the molten metal. Therefore, the rotation shaft hole 9 can be constructed by removing only an excessive portion of the gate after molding. Further, mechanical processing of the rotation shaft hole 7 of the shaft is unnecessary, and the rotation shaft hole 7 is accurately formed, whereby the sirocco fan with a high accuracy, processing for which after molding is simple, is obtainable.

In case of thixomolding, a coagulate plug 3 exists in a tip of a tip nozzle. Therefore, it is possible to prevent a molten metal from flowing, the coagulate plug 3 is accommodated in the receiver 4 by injecting the molten metal, and the molten metal flows into the gate 2. A hot runner is a mechanism for supplying a molten metal in a molten state into a cavity of a metal mold, which is ordinarily used in an injection molding machine for engineering plastics, i.e. special plastics.

When a magnesium alloy is subjected to injection molding, a melting temperature of the magnesium alloy is 600° C., which is much higher than that of engineering plastics of about 200° C. Therefore, a special heat resistance steel is used for a manifold of a hot runner and a hot tip. As illustrated in FIGS. 6 through 8, the direct gate 2 is necessary as a path for flowing a molten metal to a metal mold, and the direct gate 2 is removed thereafter, whereby an yield of a material is insufficient. Further, a cycle time of molding can be shortened by about 30%, whereby an amount of a molten metal to be actually injected is reduced. Therefore, it is reported that there is a case that an injection molding machine using a small mold locking force can be used for molding.

The hot runner mechanism is practically used by improving a heat resistance and so on of a particular electromagnetic induction heating coil in a heating and cooling mechanism. An improvement of this technique makes an operation of removing an overflow circuit, which has been necessary to deal with a difference between an injecting amount and a charging amount as a deficiency of thixomolding, easy, whereby there is a possibility to reduce a production cost and to make recycling of the overflow circuit easy.

Embodiment 8

Figure 27:
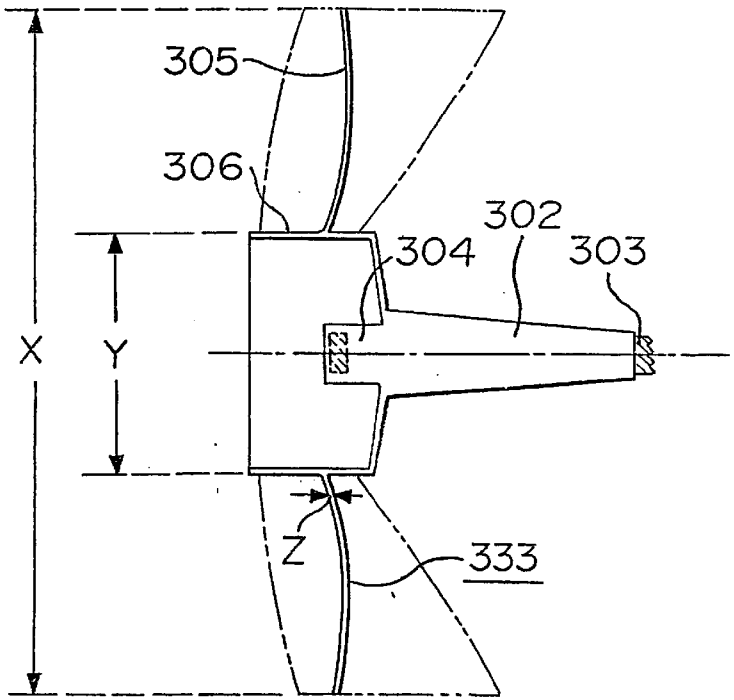
FIG. 27 is a cross-sectional view of the propeller fan before processing the gate according to Embodiment 8 of the present invention.
Figure 28:
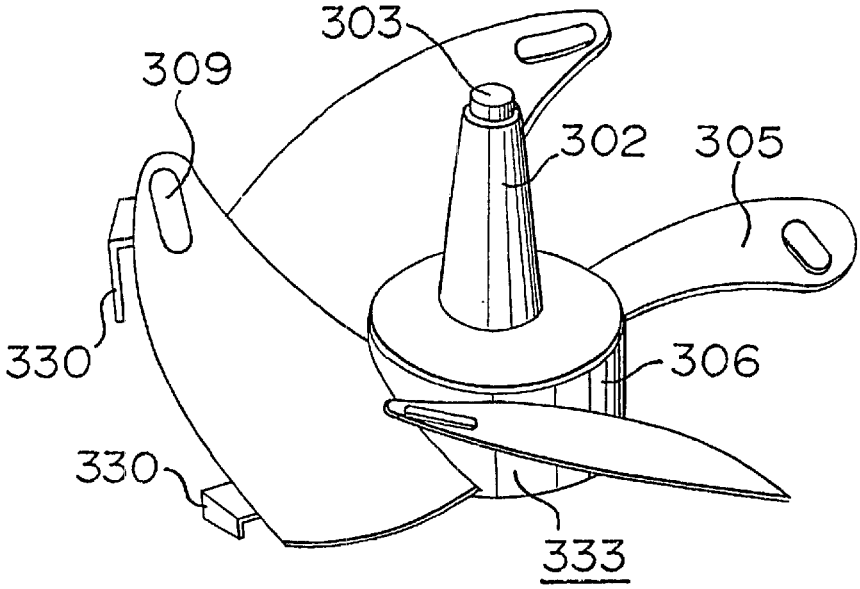
FIG. 28 is a perspective view of the propeller fan before processing the gate according to Embodiment 8 of the present invention.

Hereinbelow, Embodiment 8 of the present invention will be described in reference of figures. FIGS. 26 through 28 explain a case of producing a propeller fan. FIG. 26 is a cross-sectional view of a propeller fan in a state of processing a gate. FIG. 27 is a cross-sectional view of a propeller fan before processing the gate. FIG. 28 is a perspective view of the propeller fan before processing the gate. In FIGS. 26 through 28, numerical reference 306 designate a hub in a cylindrical shape or a conical shape, including a frustum of a corn. Numerical reference 305 designates a plurality of vanes forming an impeller 333, the vanes are monolithically formed with the hub 306. Numerical reference 308 designates a boss having a rotation shaft hole 307 to be processed after molding. Numerical reference 302 designates an entrance of a metal mold, to which a molten metal injected from an injection molding machine is flown from the boss 308 through the impeller 333. Numerical reference 303 designates a coagulate plug, which is a plug portion connected to an end portion of the gate 302, and cut at a nozzle of the injection machine. Numerical reference 304 designates a receiver, which is a plug catcher connected to an end portion of the gate 302, for accommodating a coagulate metal blocking an outlet of the nozzle of the injection molding machine. Numerical reference 309 designates an air-current separation prevention rib. Numerical reference 330 designates an overflow portion.

In structures illustrated in FIGS. 26 through 28, the impeller 333 rotates by a rotation of a motor directly connected to the rotation shaft hole 307. The shaft for supporting the rotating impeller 333 is formed as the boss 308 by removing an area surrounded by dotted lines in FIG. 26 of the gate 302 subjected to the injection molding. When an outer diameter of the boss 308 at the shaft is set to be the same as an outer diameter of the gate 302 at time of designing the metal mold, the shaft is formed by cutting a tip of the plug catcher 304 or an injection side of the gate 302 by mechanical processing, and by processing the rotation shaft hole 307. When the shaft is elongated or a diameter of the shaft is changed, it is possible to freely design by selecting dimensions of the gate of the metal mold and so on.

As described, by positioning the gate in the conical shape in a center of the hub 306, it is possible to utilize a shape of a gate injected from the injection molding machine, whereby a material can be saved while effectively using a design of the metal mold of the propeller fan, whereby it is possible to obtain with few processing. Further, a safety of a processing operation by reducing scraps of magnesium. Because the gate 302 is not positioned at a local portion of the hub 306, it is possible to uniformly charge a magnesium alloy from the center of the shaft to a circumference, in which the plurality of vanes 305 are formed. For example, when a metal fan is monolithically molded by a magnesium alloy in a metal molding, such as a thixomolding method, a molten metal is uniformly charged from the center of the shaft to the circumference, in which a large number of vanes are formed, whereby it is possible to easily deal with cases that the shaft is elongated, and the diameter of the shaft is changed.

The impeller monolithically molded out of the magnesium alloy has an excellent strength and suitable for, for example, a high revolution. When the number of revolution is doubled using a certain impeller, a quantity of an air is twice as much, a pressure is four times as much, and a power of a shaft is eight times as much. Although an output of a motor is the same as a power of a shaft, a size of a motor shaft, i.e. a rotation shaft hole 307, should be generally increased along with the output of the motor. In the present invention, it is possible to easily produce propeller fans having different rotation shaft holes 307, i.e. different outputs, without changing shapes of impellers.

In FIG. 28, numerical reference 330 designates an overflow portion. The overflow portion 330 is subjected to a vacuum draw at time of charging a molded object, i.e. the fan, with the molten metal. The overflow portion 330 to be drawn a vacuum is located in the vanes 305. By locating the overflow portion 330, it is possible to prevent an underfill and a mold cavity, which are derived from a deficiency that an injection amount and a supply amount in a thixomolding method are not completely in conformity, from generating, whereby a quality of the molded object can be improved. Because the overflow portion 330 is generally a thin connecting portion, it is possible to easily remove from the vanes 305.

FIG. 26 illustrates a structure that the thickness of a root of the vanes 305 joined to the hub 306 is smaller than two times of the thickness of an outer peripheral portion of the vanes. An effect of changing the thickness of the root of the vanes from 1.0 mm to 1.5 mm leads to a decrement of a stress by 38% and a decrement of an amount of a deformation of the vanes by 46% when calculated in use of a structural analysis program. Simultaneously, by giving a distribution to the thickness of the vanes to make the thickness of the root of the vanes within 1.5 times of the thickness of the outer peripheral portion of the vanes, a characteristic of noises are not deteriorated. Further, when the thickness of the root of the vanes is made to be less than two times of the thickness of the outer peripheral portion of the vanes, it becomes clear that such a fan can be practically used as a result of an experiment. Further, a noise can be made smaller than that in a conventional fan made of a plastic, and a deterioration of a noise is smaller than a fan having thin vanes, of which thicknesses are constant. Such fan having the constant vane thicknesses can reduce a noise as much as possible in a conventional technique. Further, a stress can be reduced, and a fan with good moldability is obtainable. As described, since the fan having an excellent strength is obtainable without deteriorating the characteristic of noises, and a material cost is scarcely changed, a production cost becomes substantially similar to that in the conventional technique.

The propeller fan illustrated in FIGS. 26 through 28 is made of a magnesium alloy. In FIGS. 26 through 28, an outer diameter X of vanes is 260 mm, and an inner diameter Y, i.e. a diameter of a hub, of the vanes is 92 mm. The thickness of a root of vanes made of an ordinary plastic should be 3.5 mm for keeping a strength. However, in the present invention, the thickness Z of the root of the vanes 305 at a position where the vanes are joined to the hub adjacent to rounded portions of the vanes is 1.5 mm because the vanes are made of the magnesium alloy having a larger, strength than a plastic. The thickness Z of the root is at least 1.5 mm for making the vanes 305, which can deal with a high rate rotation of the fan. Accordingly, the thickness of the hub 306 is 1.75 mm, a little thicker than the thickness Z of the root, in the inner peripheral portion of the vanes of 1.5 mm by changing the thickness Z of the root of the vanes from 1.0 mm to 1.5 mm, a value of stress is decreased by about 38%, and an amount of deformation is decreased by about 46% when calculated in use of a structural analysis program. Further, by unifying the thicknesses of entire vanes 33, a performance is improved.

Figure 32:
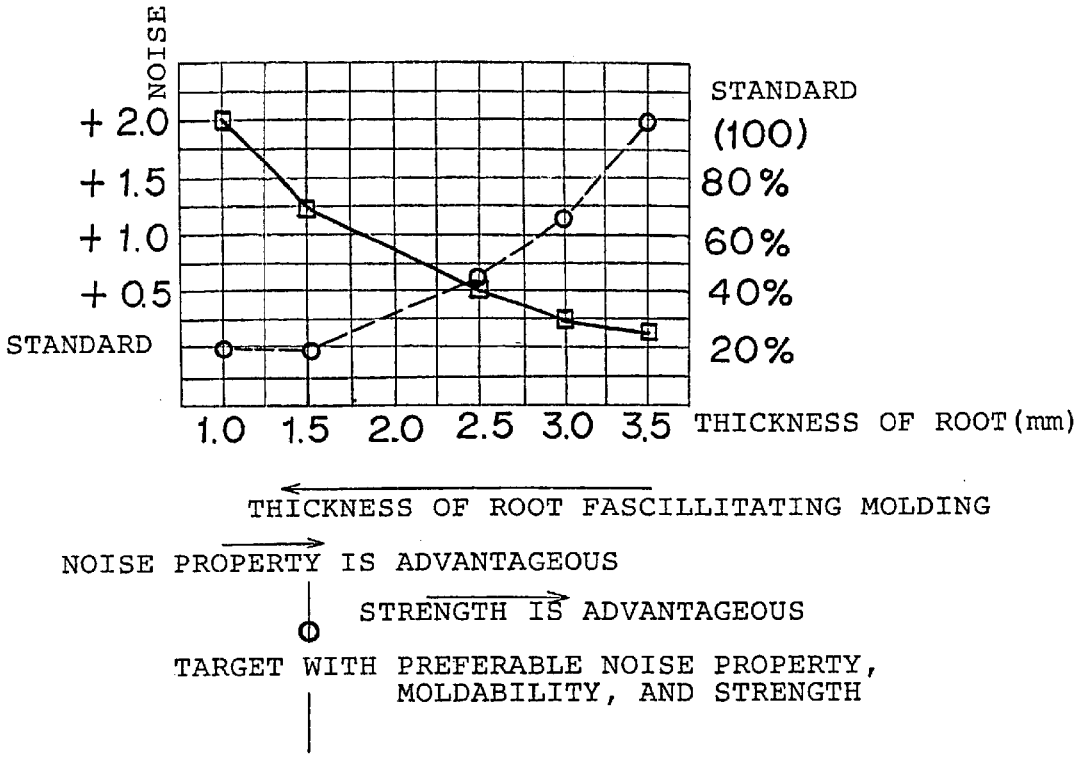
FIG. 32 illustrates a relationship among a characteristic, a strength, and moldability of the propeller fan according to Embodiment 8 of the present invention.

FIG. 32 illustrates a relationship among a characteristics of a noise, a strength, and moldability for a four-vane impeller having an outer diameter of 260 mm. FIG. 32 illustrates a case that the thickness of the root of the vanes is changed and the thickness of a tip of the vanes is 1.0 mm. An abscissa represents the thickness of the root of the vanes, and an ordinate represents a value of noise and a value of stress. In FIG. 32, a solid line designates the value of stress, which rises as the thickness of the root of the vanes decreases. A dotted line designates the value of noise, which is reduced as the thickness of the root decreases.

Accordingly, when it is necessary to improve the characteristic of the noise, to facilitate the molding, and to make a strength advantageous, the thickness of the root is preferably around 1.5 mm. However, as for the characteristic of the noise, a deterioration of the noise is about 0.3 dB when the thickness of the root is less than 2 mm. Such a thickness can be practically applied, and it is sufficient that the thickness of the root is smaller than two times of the thickness of the tip of the vanes. Further, in comparison with a conventional plastic vane, the thickness of a root of the conventional vanes is 3.5 mm, whereby a noise is increased by about 2 dB, a strength is weakened, a dimensional accuracy is deteriorated, and therefore the noise is increased. Therefore, the vanes according to the present invention generate a lower noise than that in the conventional technique by about 3 dB.

In FIG. 28, numerical reference 309 designates the air-current separation prevention rib, which is monolithically molded on an inlet side of the vanes 305. According to this Embodiment, because the vanes are monolithically molded out of a magnesium alloy, it is possible to easily locate the air-flow separation prevention rib 309 as in vanes made of plastic despite the vanes according to the present invention are made of a metal, whereby a noise is decreased without scarcely increasing a production cost. On the other hand, when the vanes are made of a thin steel plate or a thin aluminum plate like the conventional metallic vanes, it is difficult to accurately locate the air-flow separation prevention rib 309 at a low cost. For example, when the fan is bent in use of a metal mold, an outer peripheral portion of a tip of the rib is rounded, whereby there is a problem that a sufficient effect of preventing air separation is not demonstrated.

A method of producing by a direct gate method adopted in the present invention, namely a method of producing an object illustrated in a cross-sectional view of FIG. 28 before processing the gate 302, will be described. A structure of a metal mold and an operation of releasing a mold will be described in reference of FIGS. 29 through 31. Numerical reference 31 designates a molding portion of a product as vanes; numerical reference 302 designates a gate; numerical reference 401 designates a tip nozzle of an injection molding machine, i.e. a thixomolding device, in which nozzle, a coagulate plug 303 is choked. Numerical reference 402 designates a fixed portion of the metal mold, i.e. a cavity, which is fixed to the molding machine through a fixed die plate 403 by bolts and so on. Numerical reference 404 designates a movable part of the metal mold, i.e. a core, which is fixed to a movable die plate 405 by bolts and so on. The cavity 402 is constructed by a mold base 402*a* and the fixed die plate 403. A shape of one side of the product to be molded is engraved on a right side of the mold base 402*a*. There is a case that the shape of one side of the product is engraved in an insert die, and the insert die is assembled in the mold base 402*a*. The cavity 402 and the core 404 arranged opposite to the cavity 402 are constructed by the mold base 404*a*, the movable die plate 404, an ejector 404*b*, and a spacer block 404*c*. The shape of another side of the product is engraved in a left side of the mold base 404*a*. The ejector 404*b* pushes the molded object out of the metal mold in use of a force from an extrusion equipment 406. The spacer block 404*c* determines a range of leftward and rightward sliding motions of the ejector 404*b*. The stopper plate 404*d* is attached to a tip of the ejector 404*b*. The molded portion 1 is released from the mold base 404*a* on a movable side, whereby the molded object can be smoothly taken out.

In the next, a molding process will be described.

A magnesium alloy 407 as the material of the molded portion 301, i.e. the product, is housed in the tip nozzle 401 in a molten state. The magnesium alloy 407 injected from the tip nozzle 401 is charged in a shape of the product engraved in the mold base 401*a* of the fixed portion of the metal mold 402, and the mold base 404*a* of the movable part of the metal mold as the core 404 within a very short period of several dozens of microseconds through several milliseconds in case of a molding machine having a mold locking force of 450 ton. Thereafter, the molten magnesium alloy is cooled in the metal mold for several seconds to be a molded object 301. At this time, a portion for connecting the molded object 301 and the tip nozzle 401 is called the gate, which includes the plug catcher located on a side of a molded portion forming the gate, and the coagulate plug 303 located on a metal injecting side. For securely accommodating the coagulate plug 303 in the plug catcher, it is preferable to form the coagulate plug 303 so as not to be moved after a collision. By reducing a diameter of a portion of the gate 302 in contact with the hub 306, a diameter of the plug catcher 304, and a diameter of the coagulate plug 303 are smaller in this order, whereby it is possible to securely accommodate the coagulate plug in the plug catcher at time of molding. Therefore, a problem that moldability is deteriorated by a prevention of a flow of a molten metal in the gate by the coagulate plug does not occur. For example, the diameter of the portion of the gate 302 in contact with the hub 306 is 30 mm, the diameter of the plug catcher 304 is 18 mm, and the diameter of the coagulate plug 303 is 14 mm.

Figure 30:
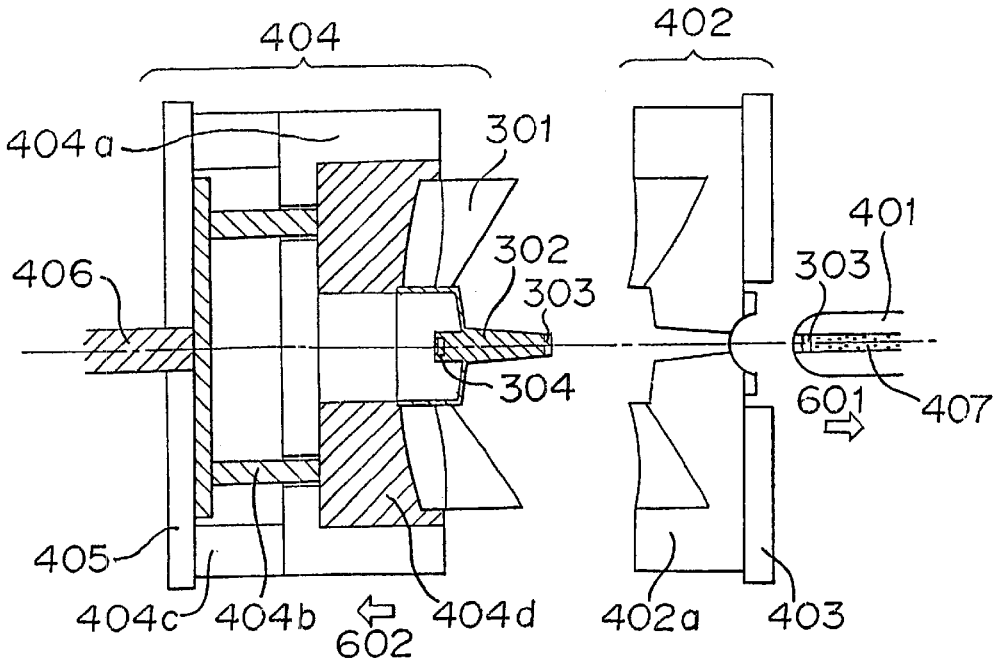
FIG. 30 is a cross-sectional view of the metal mold for producing the propeller fan according to Embodiment 8 of the present invention.

In the next, as illustrated in FIG. 30, when the tip nozzle 401 backward moves in a direction of an arrow 601 from the fixed part of the metal mold 402, namely in a right direction in the FIG. 30, the metal is cut at the coagulate plug 303 in the tip of the gate 302, whereby the molded object 301 is separated from the tip nozzle 401.

Then, the movable part of the metal mold 404 is separated from the fixed part of the metal mold 402 by an operation of the molding machine in a direction of an arrow 602. At this time, a resistance of releasing the mold between the mold base 404 of the movable portion of the metal mold and the molded object 1 should be smaller in the fixed side than in the movable side.

Figure 31:
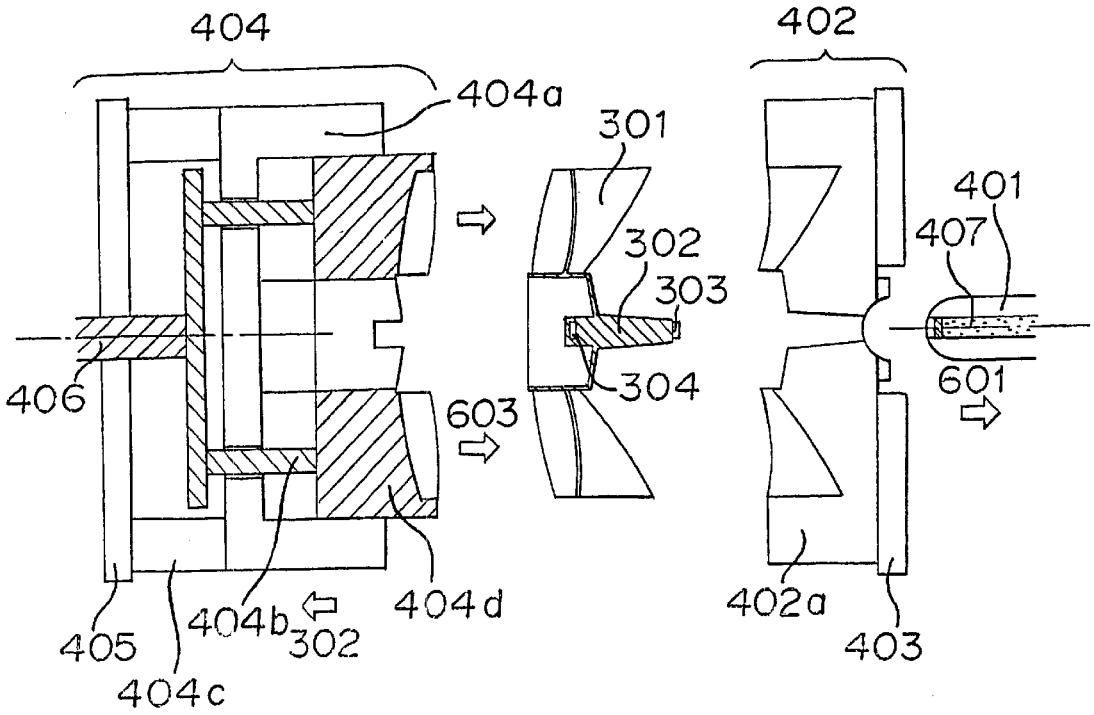
FIG. 31 is a cross-sectional view of the metal mold for producing the propeller fan according to Embodiment 8 of the present invention.

Finally, as illustrated in FIG. 31, the stopper plate 404*d* attached to a tip of the ejector 404*b* slides toward the fixed part of the metal mold 402 by a force of the extrusion 406 to thereby take the molded object 301 out of the mold base 404*a* of the movable part of the metal mold 404.

In use of such a molding machine, it is possible to monolithically mold the propeller fan, in which a large number of vanes are formed from a center of a shaft, out of, for example, a magnesium alloy within a short time with a high accuracy.

Besides, the method of injection molding by, namely, a thixomolding method, a die-cast method may be used for monolithically molding a propeller fan out of a magnesium alloy. A die-cast method is disclosed in the above-mentioned "Magnesium Dokuhon, by author Shoutarou Morozumi, published by Karosu Shuppan".

There are a cold chamber method and a hot chamber method in the die-cast method. Since the die-cast method has already been described in Embodiment 1 with reference to FIGS. 21*a* through 22*b*, a description is omitted.

Figure 37A:
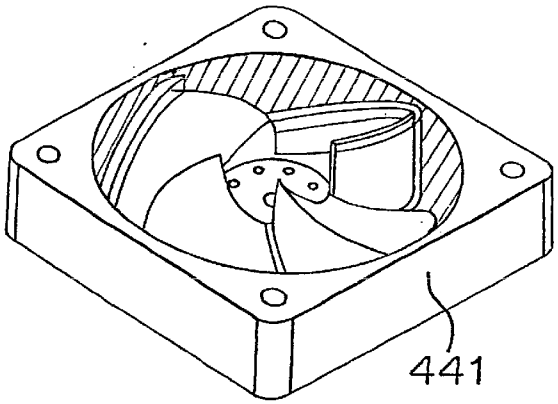
FIG. 37*a* is a perspective view of a metal mold for trimming.
Figure 37B:
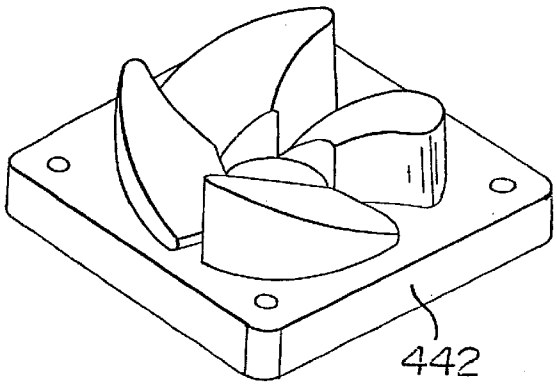
FIG. 37*b* illustrates a perspective view of the metal mold for trimming.

In FIGS. 37*a* and 37*b*, an example of removing the overflow portion 330 illustrated in FIG. 28 is explained. FIG. 37*a* is a perspective view of an upper trimming die; and FIG. 37*b* is a perspective view of a lower trimming die.

There are methods of processing by a manual operation and a method of cutting by a press machine in use of the trimming metal dice in this Embodiment. Numerical reference 441 designates the upper trimming die; and numerical reference 442 designates the lower trimming die. The trimming dice are attached to the press machine. A product having the overflow portion 330, for example, illustrated in FIG. 28, is mounted on a lower trimming die, and the upper trimming die 441 is downward moved to remove an outer peripheral portion of the vanes by pressing.

Although the trimming die in a shape of a flat plate can be produced at a relatively low cost, three-dimensional object like an outer peripheral portion of vanes of a propeller fan needs a high cost. In other words, when a cost of a trimming die can be depreciated by a mass production, the cost of the trimming die is excessively necessary but a cost of processing can be made low. Therefore, the method is suitable for a mass production. On the contrary, when a production number is small, it is better to process by a manual operation without making the trimming die.

Embodiment 9

Figure 33:
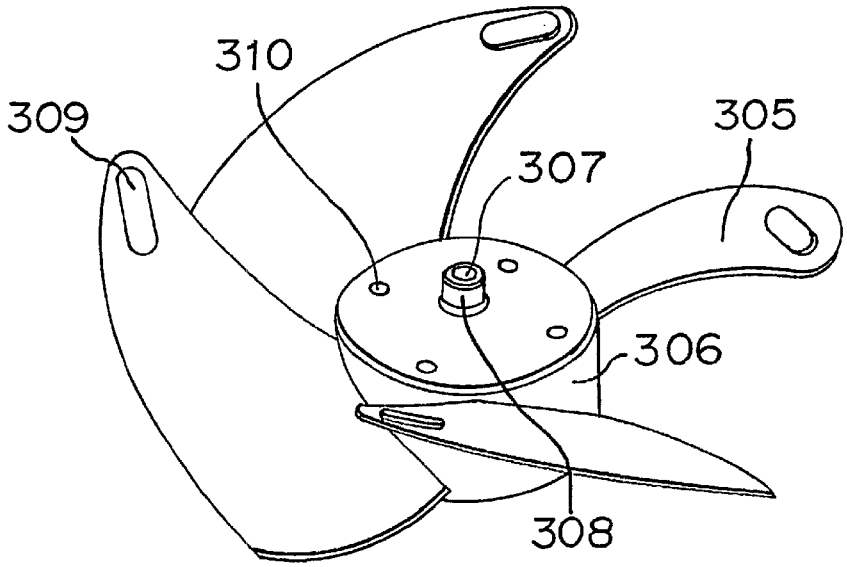
FIG. 33 is a perspective view of a propeller fan in a state of processing a gate according to Embodiment 9 of the present invention.
Figure 34:
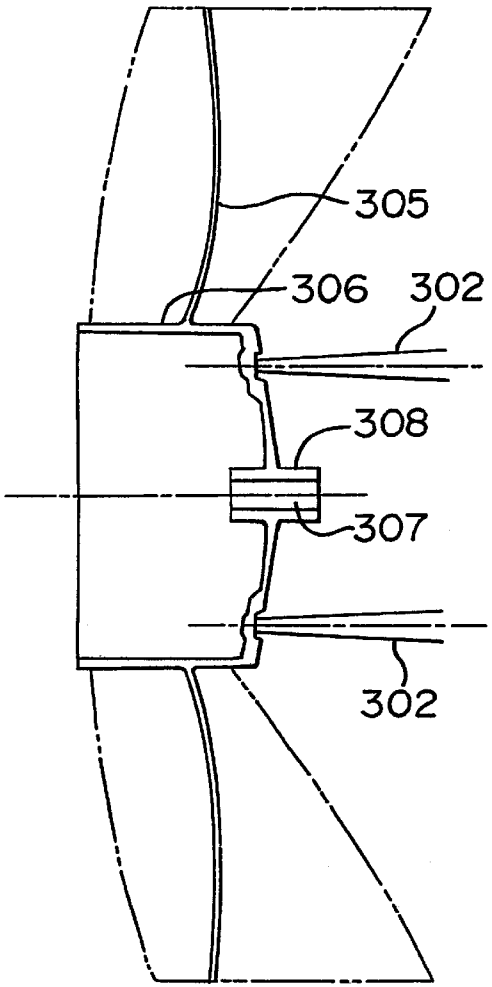
FIG. 34 is a cross-sectional view of the propeller fan before processing the gate according to Embodiment 9 of the present invention.

Embodiment 9 of the present invention will be described in reference of figures. FIGS. 33 and 34 shows a method of producing a propeller fan by a pin gate method.

A propeller fan can be produced in use of a direct gate method or a pin gate methods. In the direct gate method, a magnesium alloy as a material of vanes is directly charged from a center of a rotation shaft, i.e. a center of a hub 306. In the pin gate method, a magnesium alloy as a material of vanes is directly charged from a plurality of portions in the hub 306. Further, although there is a side gate method as one of gate methods, the side gate method has deficiencies that it is difficult to uniformly charge the magnesium alloy into a plurality of thin vanes, it is complicated to process a gate and to make a metal mold because an outer peripheral portion of vanes is in a three-dimensional shape, a projecting area of an entire molded portions including a gate become large, and resultantly the metal mold becomes large and a molding machine also becomes large. Therefore, the side gate method is not suitable for the method for producing the propeller fan according to this embodiment.

Although a case that a single gate is used to inject the molten metal from the nozzle in Embodiment 8, it is possible to charge for a molded object by branching a metal injected from a single nozzle into plural numbers at a gate to supply from a plurality of small inlets through a pin gate 302. In such a case, the pin gate 302 is located between the nozzle of the injection molding machine and a molded object in the metal mold.

FIG. 33 is a perspective view of the propeller fan. Numerical reference 305 designates vanes; numerical reference 306 designates a hub; numerical reference 308 designates a boss; numerical reference 309 designates an air-flow separation prevention rib monolithically molded on a negative pressure side, i.e. an intake side, of the vanes 5; and numerical reference 310 designates a recess formed in the hub 6. Further, FIG. 34 is a cross-sectional view of FIG. 33.

According to this method, it is possible to further easily produce the fan without later processing the boss 308 of a rotation shaft hole 307.

For producing in such a way, the thickness of an outer peripheral portion of the hub on a blowing side, i.e. a positive pressure surface side, of the vanes is 1.5 times of the thickness of the other portions of the hub, and the recess 310 is formed as much as the number of the vanes or more for processing a plurality of pin gates of the gate, from which a magnesium alloy is charged. In comparison with a case that the number of the recesses is smaller than the number of vanes, the molten metal can be uniformly charged into the plurality of vanes, and moldability is good.

A shape of the recesses 310 is such that an outer diameter is 6 mm, and a depth is 1 mm for processing the gate, where the outer diameter of the pin gate is 4 mm. The number of the pin gates is four in case that the number of vanes is four. In such a case, a scrubbing cloth and so on is not hung at by the gate at time of cleaning because the gate is well processed. However, it is not possible to arbitrarily change the rotation shaft 309 according to this method.

As described, it is possible to further easily produce the fan without later processing the boss in the rotation shaft hole. Further, it is possible to provided the fan subjected to good gate processing, at which a scrubbing cloth and so on are not hung up at time of cleaning.

Embodiment 10

Figure 35:
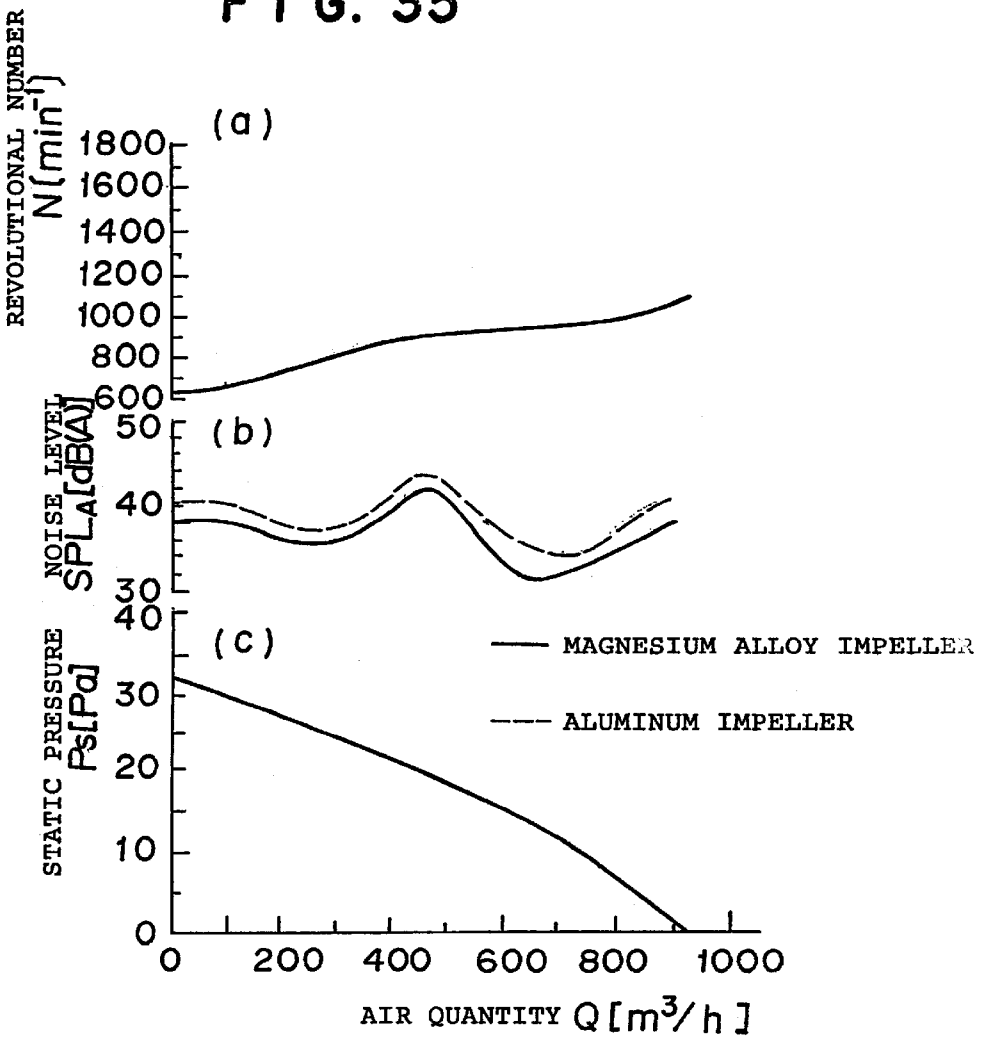
FIG. 35 illustrates a comparison among propeller fans according to Embodiment 10 of the present invention.

FIG. 35 illustrates a comparison between performances of a case that a material of vanes 305 is an aluminum plate, the plate thickness is 1.2 mm, and an outer diameter of the vanes is 260 mm, disclosed in Japanese Examined Utility Model JP-B-3-54337, and of a case that an air-flow separation prevention rib 309 is located in Embodiment 8 with reference to FIGS. 26 through 28. In FIG. 35*a*, an abscissa represents an air quantity Q [$m^3$/h] of a fan, an ordinate represents a number of revolution N [$min^{-1}$]. In FIG. 35*b*, an abscissa represents an air quantity Q [$m^3$/h] of a fan, an ordinate represents a noise level $SPL_A$ [dB(A)]. In FIG. 35*c*, an abscissa represents an air quantity Q [$m^3$/h] of a fan, an ordinate represents a static pressure Ps Pa.

In FIGS. 35*a* through 35*c*, a solid line designates an impeller made of a magnesium alloy, and a dotted line designates an impeller made of an aluminum plate. When the air quantity is large, a noise of the impeller made of the magnesium alloy is smaller than the impeller made of the aluminum plate by 3 dB. The air-flow separation prevention rib 309, monolithically molded with the impeller, contributes these differences. Further, when the air quantity is intermediate, the noise of the impeller made of the magnesium alloy is smaller by about 4 dB. This is because the noise of an air flowing in a range of the intermediate air quantity is produced because it is impossible to produce an ideal shape of vanes at the hub of the fan made of the aluminum plate because an abrupt bending is impossible in producing the fan. Accordingly, it is possible to reduce the noise of the impeller made of the magnesium alloy in entire regions of the air quantity.

In case of thixomolding, a coagulate plug 303 is positioned in a tip of a tip nozzle to prevent a molten metal from flowing. The coagulate plug 303 is housed in a receiver 304 by injecting the molten metal, whereby the molten metal flows into a gate 302. A hot runner is a mechanism for supplying a molten metal in a state that the molten metal is completely melted in a cavity of a metal mold, which is ordinarily used in an injection molding machine for engineering plastics, i.e. special plastics.

In injection molding of a magnesium alloy, a dissolving temperature is 600° C. which is much higher than that for engineering plastics of about 200° C. Therefore, a manifold of the hot runner and a hot tip made by a special heat resistance steel to deal therewith. As described in reference of FIGS. 29 through 31, it is necessary to locate a direct gate portion 302 as a path of a molten metal to a metal mold, and the direct gate portion is removed thereafter, whereby a use of the material is low. Further, because it is possible to reduce a cycle time of molding by about 30%, and a quantity of molten metal to be practically injected is reduced, it is reported that there is a case that a fan can be molded in use of an injection molding machine having a small mold locking force.

The hot runner mechanism is practically used by improving a heat resistance of a particular electromagnetic induction heating coil of a heating and cooling mechanism. It becomes easy to remove an overflow circuit, which is necessary to deal with the difference between the injection amount and a charging amount as a efficiency in thixomolding, by making a size of overflow circuit small, whereby there is a possibility to facilitate a reduction of production cost and recycling of the overflow circuit.

Embodiment 11

Figure 36A:
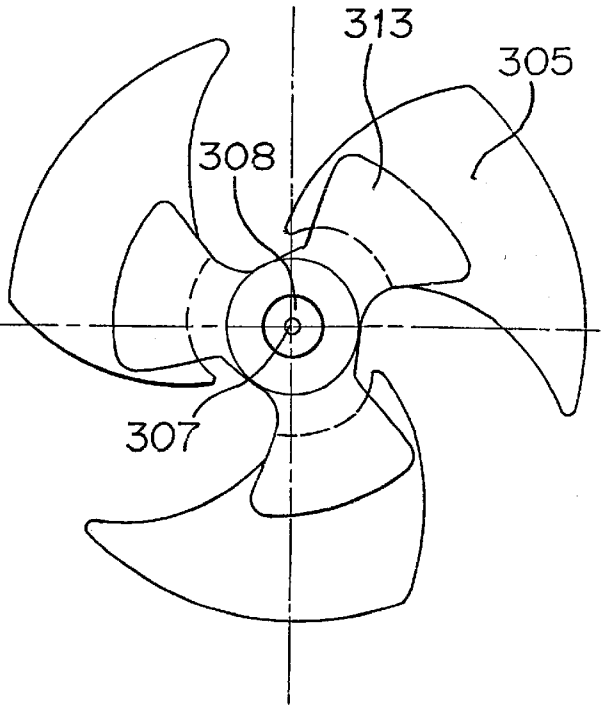
FIG. 36*a* illustrates a front view of a propeller fan according to Embodiment 11 of the present invention.
Figure 36B:
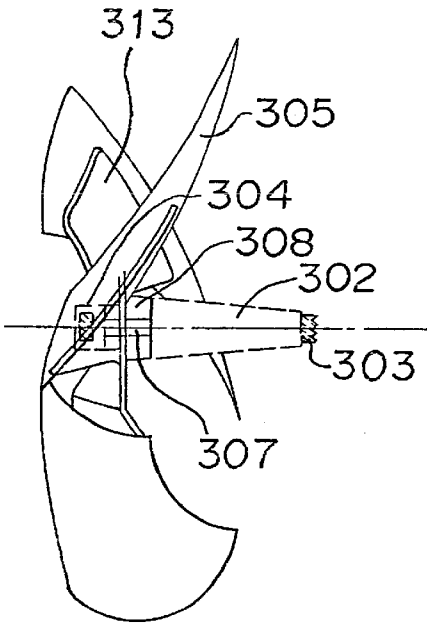
FIG. 36*b* illustrates a side view of the propeller fan according to Embodiment 11 of the present invention.

FIGS. 36*a* and 36*b* illustrate a propeller fan according to Embodiment 11 of the present invention. FIG. 36*a* is a side view of the propeller fan, and FIG. 36*b* is a front view of the propeller fan. Numerical reference 305 designates vanes; numerical reference 307 designates a rotation shaft hole; numerical reference 308 designates a boss; and numerical reference 313 designates a spider. The thin vanes 305 and the thick spider 313, which is thicker than the vanes, are monolithically molded; a gate 302 for charging a magnesium alloy into the rotation shaft hole 307 located in the spider 313 is equipped; a plug catcher 304 for accommodating a coagulate plug 303 in thixomolding is located on a blowing side, i.e. a positive pressure surface side, of the vanes opposite to the gate 302; the gate 302 and plug catcher 304 are processed in a later step; and the boss 308 having the rotation shaft hole 307 is constructed. According to Embodiment 11, because the propeller fan can be monolithically molded out of the magnesium alloy, it is possible to freely design the thickness of the connecting portion between the vanes and the spider, a strength is high, the noise if low, and it is possible to easily produce the relatively large metallic fan, which is suitable for recycling, by monolithically molding.

When the thicknesses of the vanes of the propeller fan are the same, it is possible to realize a light weight at a low material cost, of which noise is most low as long as there is no problem of strength and moldability.

The above-mentioned magnesium alloy is, for example, AZ91D. Since the magnesium has not only a low fusion point but also a small density in comparison with further metals, namely two third of aluminum, and one fourth of iron. Therefore, it is possible to produce the light weight propeller fan, which is most suitable for a rotating object. Further, excellent characteristics are shown in terms of a specific intensity, specific durability, a vibration dissipation property, a heat radiation, dimensional stability, an electromagnetic wave shielding property and so on.

By marking to indicate that a component is made of a magnesium alloy using, for example, AZ91D, a rate of recycling is improved.

Embodiment 12

Figure 29:
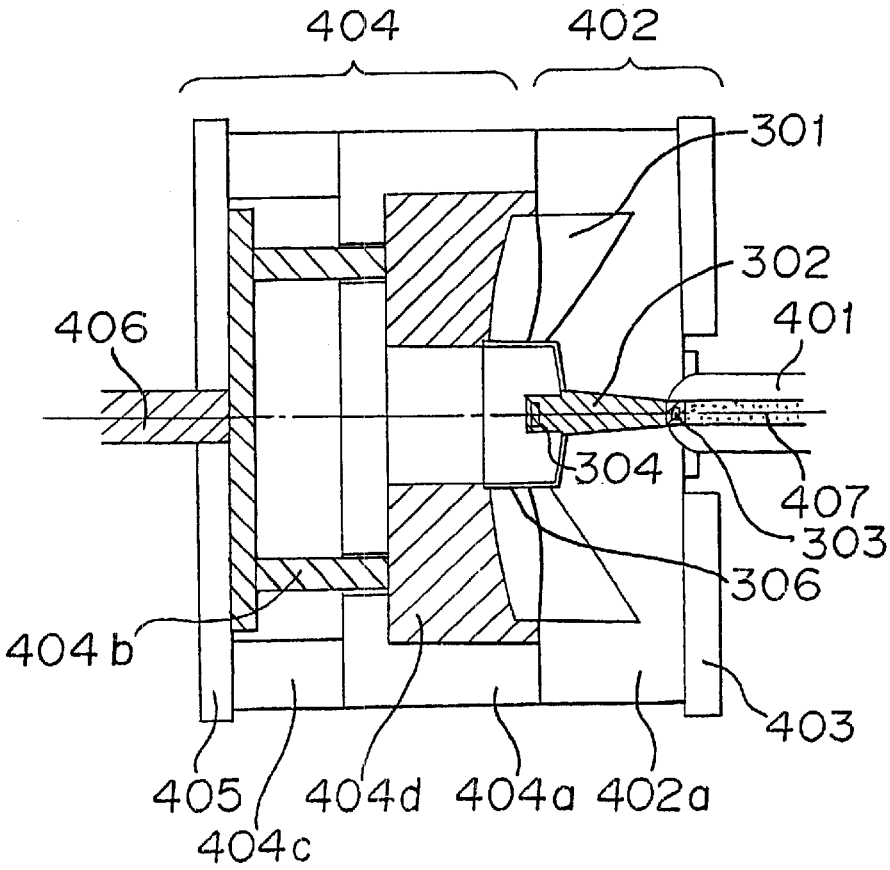
FIG. 29 is a cross-sectional view of a metal mold for producing the propeller fan according to Embodiment 8 of the present invention.
Figure 38:
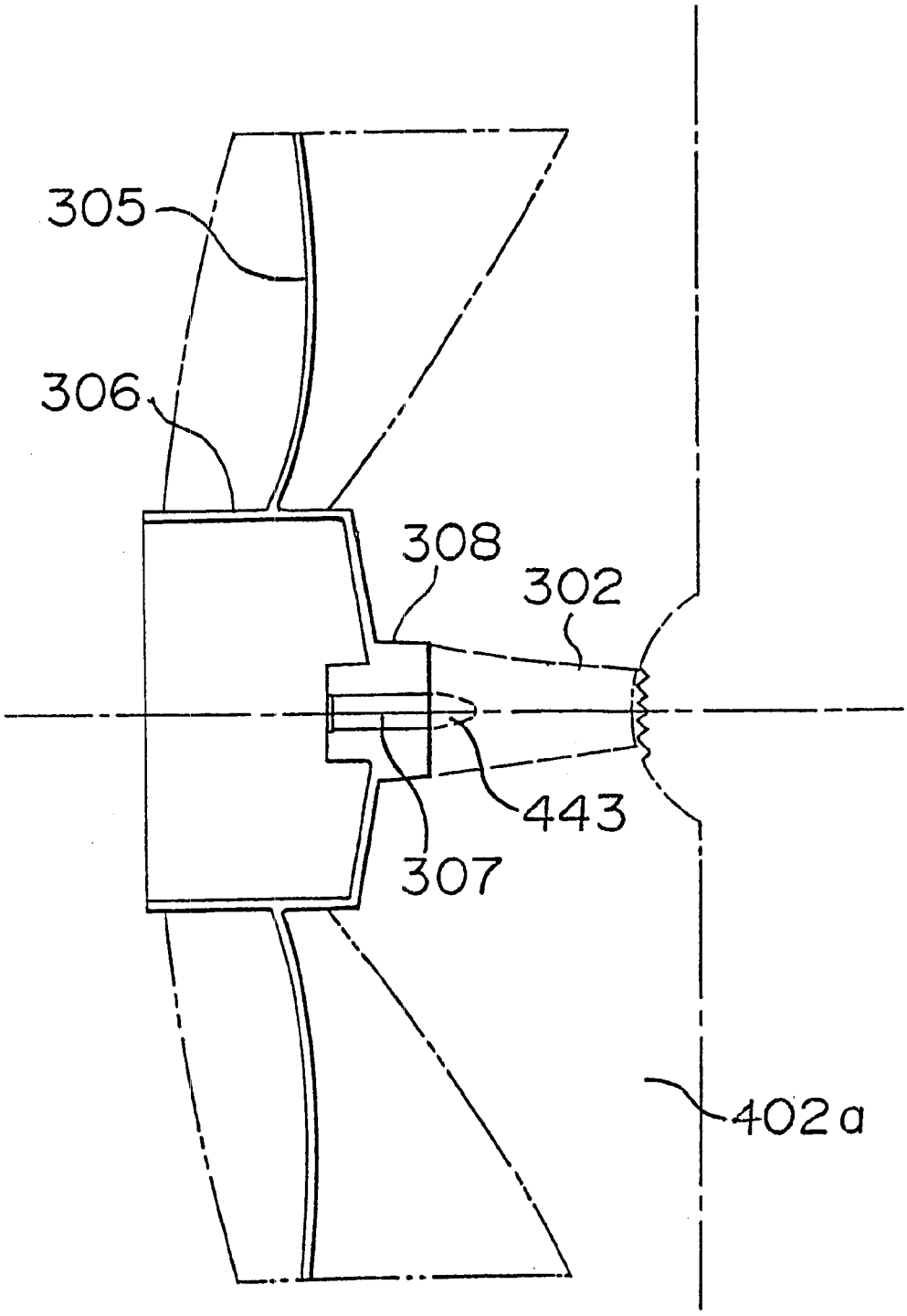
FIG. 38 illustrates a cross-sectional view of a propeller fan in a state of processing a gate according to Embodiment 12 of the present invention.
Figure 40:
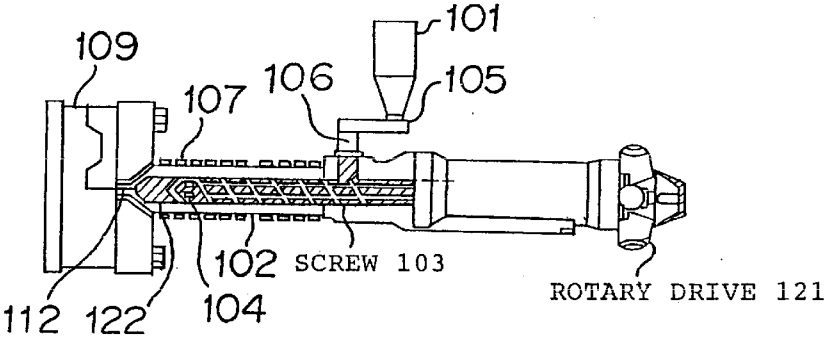
FIG. 40 illustrates a structure of a conventional magnesium alloy injection molding machine.
Figure 41:
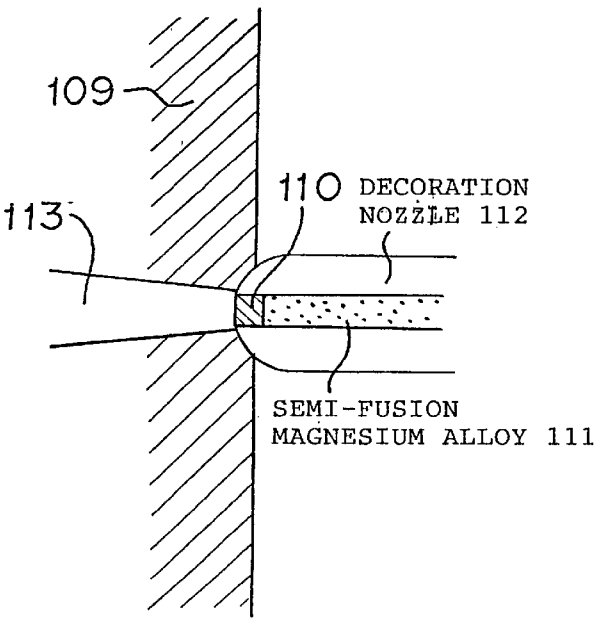
FIG. 41 illustrates a structure of a nozzle of a conventional injection molding machine.
Figure 39:
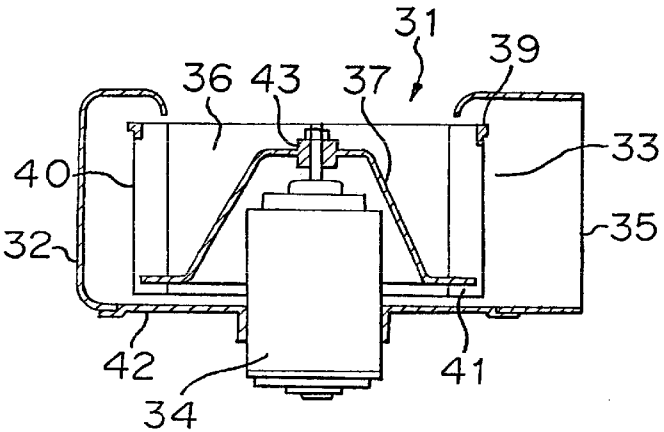
FIG. 39 illustrates a structure of a conventional sirocco fan.
Figure 42:
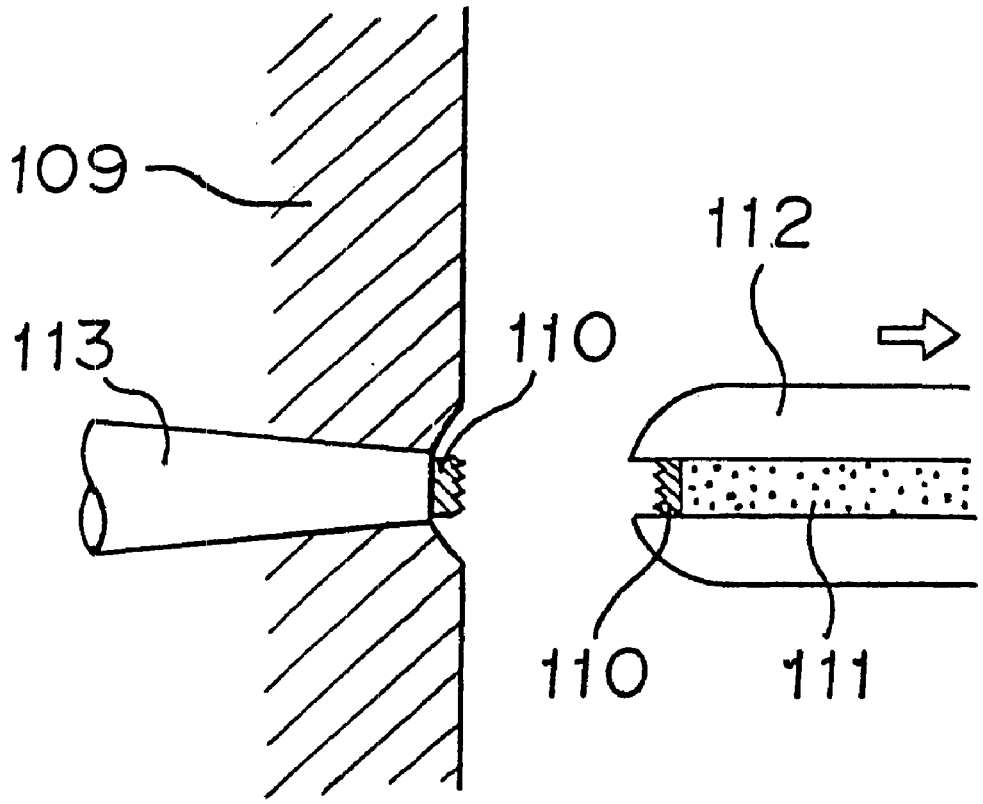
FIG. 42 illustrates a state that the nozzle of the convention injection molding machine is separated from a metal mold.

FIG. 38 is a cross-sectional view of a propeller fan according to Embodiment 12 of the present invention before processing a gate. The same numerical references as those in FIGS. 26 and 29 designate the same portions. In FIGS. 26 and 29, numerical reference 302 designates a gate; numerical reference 305 designates vanes; numerical reference 306 designates a hub; numerical reference 307 designates a rotation shaft hole; numerical reference 308 designates a boss; numerical reference 402*a* designates a mold base, on a right side of which a shape of one side of a product to be molded is engraved; and numerical reference 443 designates a rotation shaft metal mold pin.

A structure illustrated in FIG. 38 is applied to in case of a magnesium die-cast method described above and a hot runner method of a thixomolding method, wherein it is abolish to publish the coagulate plug 303 for preventing the molten metal from flowing illustrated in FIG. 26 and the receiver 304 for accommodating the molten metal. Since the receiver 304 is not necessary, there is no need to remove the receiver in a later process as illustrated in FIG. 26. By forming a shaft hole in a portion constituting an inner surface side of the hub 306 on a movable side of the metal mold, it is possible to form the rotation shaft hole 307 at a time of molding, whereby a later process becomes very easy by cutting only a tip of the gate 302. Further, in case of forming the shaft hole in a later process, a jig should be accurately formed to avoid insufficient balancing caused by a deviation between the hub 306 and a shaft center of about 0.1 through 0.2 mm. In Embodiment 12, because the rotation shaft hole 307 is monolithically molded, a position of the rotation shaft hole 307 is very accurately processed.

As illustrated in FIG. 38, by shaping a tip of the rotation shaft metal mold pin 443 like a bullet or a hemisphere in a right side of FIG. 38, it is possible to cancel a phenomenon that a flow of the molten metal is prevented by an existence of the rotation shaft metal mold pin at a time that the molten metal flows from the gate 302 to the hub 306. Further, when a diameter of the rotation shaft hole 307 is increased, it is necessary to increase an outer diameter of the boss 308 for keeping an area of a flow path of the molten metal in the gate 302. However, when it is difficult to make the outer diameter of the boss 308 large, the rotation shaft hole formed by the rotation shaft metal mold pin 443 is enlarged in a later process. In such a case, because the shaft hole is already opened and the shaft hole is not processed from the beginning, the shaft hole can be easily processed, and a power of an actuating motor becomes large. In a similar manner thereto, it is also possible to deal with a case that a diameter of an actuating motor shaft is increased.

The rotation shaft metal mold pin 443 may be constructed by locating a pin having a shape similar to that of the rotation shaft hole 307 on a side of a movable part of the metal mold opposite to an injection side of the gate 302.

As described, in Embodiment 12, there are steps of providing the rotation shaft metal mold pin 443 having a similar shape to the rotation shaft hole 307 in the metal mold and injecting the molten metal from the shaft monolithically molded with an impeller, which shaft is located in a center of a hub for supporting the impeller and rotated by the motor by melting the metal, and of forming the rotation shaft hole 307 by removing a part of the gate after making a molded object by injecting the molten metal. Accordingly, it becomes possible to form the rotation shaft hole 307 by removing an excessive part of the gate after molding. Further, it becomes unnecessary to mechanically process the rotation shaft hole 307, the mechanical process becomes highly accurate, whereby it is possible to obtain the propeller fan having a high accuracy, for which processing after molding is simple.

The first advantage of the fan according to the present invention is that it is possible to uniformly charge the molten metal into various portion to the fan, and it is possible to easily deal with cases that the shaft is elongated and a shaft diameter is changed.

The second advantage of the fan according to the present invention is that a safety in processing is enhanced by a structure necessitating few processing and a processing scrap of the molded object is reduced.

The third advantage of the fan according to the present invention is that a quality of the molded object can be improved by preventing an underfill and a mold cavity from occurring.

The fourth advantage of the fan according to the present invention is that it is possible to obtain the molded object with a good appearance in surfaces of the entire fan and of thin plates along with good moldability.

The fifth advantage of the fan according to the present invention is that it is possible to obtain the molded object with a good quality and good moldability by preventing an underfill and a mold cavity.

The sixth advantage of the fan according to the present invention is that moldability of a large number of thin plates is further increased, and the molded object with a good quality is obtainable.

The seventh advantage of the fan according to the present invention is that it is possible to completely remove an underfill in the back edge of the outer peripheral portion of the vanes, a rotational balance is good, and an yield in molding is improved.

The eighth advantage of the fan according to the present invention is that the ejector pin is unnecessitated, the metal mold can be produced at a low cost, and durability of the metal mold is improved.

The ninth advantage of the fan according to the present invention is that the width of the stiffening ring can be freely designed, and vanes having narrow widths can be freely constructed.

The tenth advantage of the fan according to the present invention is that the joint between the monolithically formed vanes and the main plate becomes further accurate and firm.

The eleventh advantage of the fan according to the present invention is that a flow air is not influenced by the stiffening ring left in the outer peripheral portion of the vanes.

The twelfth advantage of the fan according to the present invention is that mechanical processing becomes easy and a capability of blowing an air becomes good.

The thirteenth advantage of the fan according to the present invention is that the joint between the stiffening ring and the vanes becomes firm, and a blowing air is not influenced by removing a rounded portion of the outer peripheral portion of the vanes.

The thirteenth advantage of the fan according to the present invention is that the fan is suitable for recycling, is light, and has a sufficient strength, and it is possible to provide the fan having a low noise at a low cost.

The fifteenth advantage of the method of producing the fan according to the present invention is that it is possible to easily deal with changes of the length of the shaft and of the diameter of the shaft by changing only the dimensions for processing the gate.

The sixteenth advantage of the method of producing the fan according to the present invention is that the fan is formed without mechanical processing of the rotation shaft hole of the shaft, the fan is formed with a high accuracy, and processing after molding is simplified.

The seventeenth advantage of the method of producing the fan according to the present invention is that the method of molding molded objects with stable qualities, by which an underfill and a mold cavity are always prevented.

The eighteenth advantage of the method of molding the fan according to the present invention is that the molten metals are uniformly charged into each of the vanes.

The nineteenth advantage of the molten metal molding device according to the present invention is that the molten metal can be instantaneously charged into an entire impeller having a complicated shape.

The twentieth advantage of the molten metal molding device according to the present invention is that unnecessary processing is omitted.

The twenty-first advantage of the molten metal molding device according to the present invention is that the production is facilitated without processing the shaft.

The twenty-second advantage of the molten metal molding device according to the present invention is that the gate is preferably processed at time of producing the fan, and a scrubbing cloth is not hung up at the gate thereof at time of cleaning the molded object in use.

Obviously, numerous modifications and variations of the present invention are possible in light of the above teachings. It is therefore to be understood that within the scope of the appended claims, the invention may be practiced otherwise than as specifically described herein. Also, disclosure of bases of convention rights, i.e. Japanese Patent Application Nos. Hei 11-055123, Hei 11-055124, Hei 11-358935, and Hei 11-358936, of the present application are included in disclosure of the present application.

What is claimed is:

1. A fusion metal molding method for molding a sirocco fan by melting and injecting metal from a metal molding machine into a metal mold comprising steps of:

injecting a molten metal from a gate positioned at a shaft for monolithically molding the shaft, which shaft is located in a center of a main plate for supporting an impeller, and which is adapted to be rotated by a motor; and forming the shaft by removing a coagulate metal coagulated and blown off by a nozzle of the metal molding machine from the gate.

2. A fusion metal molding method for producing a sirocco fan, which is molded using a metal mold having a gate, at least part of the gate defining a shaft, by melting and blowing off metal from a metal molding machine into the metal mold comprising steps of:

injecting a molten metal into a metal mold, the metal mold having a gate, at least part of the gate defining a shaft of a fan, the shaft being located in a center of a hub for supporting an impeller, the shaft being adapted to be rotated by a motor, the molten metal being injected so that the shaft and the impeller are monolithically molded; and forming a shaft hole by removing a part of the gate after injecting the molten metal.

3. A fusion metal molding method for producing a sirocco fan including an impeller shaped like a cylinder by joining a plurality of vanes to a stiffening ring for supporting a side opposite to the joining side of the vanes comprising the steps of:

connecting a nozzle of a metal molding machine at a position of a shaft in a center of a main plate, the main plate being arranged on one side of the impeller, and injecting a metal, at least a part of which is melted; and charging the injected metal into vanes and a stiffening ring of the fan such that at least some of the injected metal flows into an overflow portion connected with the stiffening ring.

4. A fusion metal molding method for producing a sirocco fan including an impeller shaped like a cylinder by joining a plurality of vanes and a stiffening ring for supporting a side opposite to the joining portion of the vanes comprising the steps of:

connecting a nozzle of a metal molding machine at a position of a shaft in a center of a main plate, the main plate being arranged on one side of the impeller, and injecting a molten metal, at least a part of which is melted;

filling the injected metal into the vanes, the stiffening ring, and a mold ring located in an outer periphery of the impeller; and removing the mold ring.

5. A molten metal molding method for producing a propeller fan, formed by melting at least a part of a metal from a metal molding machine and blowing it from a nozzle to a metal mold comprising steps of:

injecting a molten metal into a gate of a metal mold, the gate at least partially defining a shaft of a propeller fan, the shaft being located in a center of a hub for supporting an impeller of the propeller fan and being adatped to be rotated by a motor, the molten metal being injected such that the shaft is monolithically molded with the impeller; and removing a coagulate metal, coagulated in and blown off from the nozzle, out of the gate after molding the propeller fan.

6. A fusion metal molding method for producing a propeller fan, molded using a metal mold having a gate, at least a portion of the gate defining a shaft of the propeller fan, by melting metal from a metal molding machine, and blowing it off from a nozzle into the metal mold, comprising steps of:

injecting molten metal into a gate of a mold, the gate at least partially defining a shaft of a propeller fan, the shaft being located in a center of a hub for supporting an impeller and being adapted to be rotated by a motor, such that the shaft and the impeller are monolithically molded; and forming a shaft hole by removing a part of the gate after molding the shaft and the impeller.

7. A molten metal molding method for producing a propeller fan, formed by monolithically molding an outer peripheral portion of a hub and a plurality of vanes, comprising steps of:

connecting a nozzle of a metal molding machine at a position of a shaft in a center of a hub of the fan and injecting the metal, at least a part of which is melted, to form a molded object including an outer peripheral portion of a hub and a plurality of vanes attached to the hub;

charging the injected metal into an overflow portion connected to the impeller and an outer peripheral portion of the vanes of the impeller; and removing the overflow portion.

* * * * *